US010383391B2

(12) United States Patent
Mitsui et al.

(10) Patent No.: US 10,383,391 B2
(45) Date of Patent: Aug. 20, 2019

(54) SHOCK ABSORBING STRUCTURE AND SHOE TO WHICH THE SHOCK ABSORBING STRUCTURE IS APPLIED

(71) Applicants: ASICS CORPORATION, Kobe-shi, Hyogo (JP); TAICA CORPORATION, Tokyo (JP)

(72) Inventors: Shigeyuki Mitsui, Kobe (JP); Manabu Mikuni, Tokyo (JP); Hiroshi Nasuno, Tokyo (JP)

(73) Assignees: ASICS CORPORATION, Kobe (JP); TAICA CORPORATION, Tokyo (JP)

( * ) Notice: Subject to any disclaimer, the term of this patent is extended or adjusted under 35 U.S.C. 154(b) by 234 days.

(21) Appl. No.: 15/116,604

(22) PCT Filed: Mar. 6, 2014

(86) PCT No.: PCT/JP2014/055792

§ 371 (c)(1),
(2) Date: Aug. 4, 2016

(87) PCT Pub. No.: WO2015/132933

PCT Pub. Date: Sep. 11, 2015

(65) Prior Publication Data

US 2016/0360830 A1 Dec. 15, 2016

(51) Int. Cl.
*A43B 13/18* (2006.01)
*A43B 13/12* (2006.01)
(Continued)

(52) U.S. Cl.
CPC ..... *A43B 13/186* (2013.01); *A43B 3/128* (2013.01); *A43B 5/00* (2013.01); *A43B 7/1465* (2013.01); *A43B 13/122* (2013.01); *A43B 13/188* (2013.01)

(58) Field of Classification Search
CPC ... A43B 13/186; A43B 13/122; A43B 13/188; A43B 3/128; A43B 7/1465; A43B 5/00
See application file for complete search history.

(56) References Cited

U.S. PATENT DOCUMENTS 4,342,158 A * 8/1982 McMahon ..... A43B 21/26 36/114
5,233,767 A * 8/1993 Kramer ..... A43B 7/081 36/28

(Continued)

FOREIGN PATENT DOCUMENTS

JP S63-159501 U 10/1988
JP H01-274705 A 11/1989

(Continued)

OTHER PUBLICATIONS

Jun. 3, 2014 International Search Report issued in International Patent Application No. PCT/JP2014/055792.

*Primary Examiner* — Jila M Mohandesi
(74) *Attorney, Agent, or Firm* — Oliff PLC

(57) ABSTRACT

A shock absorbing structure formed by including a column member, a ring member that is provided by being fitted onto the column member and has elasticity, a first pressure receiving portion that is connected to an upper end of the column member, and a second pressure receiving portion that is connected to a lower end of the column member, wherein the column member tilts with respect to at least one of the first and second pressure receiving portions with pressure reception, and is restored with decompression, and the ring member is caused to undergo bulging deformation to an outer circumferential side direction from an inner circumferential side by tilting of the column member.

16 Claims, 21 Drawing Sheets

(51) Int. Cl.

| | |
|---|---|
| ***A43B 5/00*** | (2006.01) |
| ***A43B 7/14*** | (2006.01) |
| ***A43B 3/12*** | (2006.01) |

(56) References Cited

U.S. PATENT DOCUMENTS

| | | | | |
|---|---|---|---|---|
| 5,343,639 | A * | 9/1994 | Kilgore | A43B 13/183 36/27 |
| 5,607,749 | A * | 3/1997 | Strumor | A43B 7/146 428/156 |
| 7,100,309 | B2 * | 9/2006 | Smith | A43B 13/181 36/114 |
| 7,866,063 | B2 * | 1/2011 | Caine | A43B 13/026 36/114 |
| 7,877,899 | B2 | 2/2011 | Nishiwaki et al. | |
| 2007/0256326 | A1 * | 11/2007 | Jarvis | A43B 13/12 36/28 |

FOREIGN PATENT DOCUMENTS

| | | | |
|---|---|---|---|
| JP | H03-170102 | A | 7/1991 |
| JP | H03-170104 | A | 7/1991 |
| JP | H04-300433 | A | 10/1992 |
| JP | H05-20808 | Y2 | 5/1993 |
| JP | 2003-009904 | A | 1/2003 |
| JP | 3425630 | B2 | 7/2003 |
| JP | 4020664 | B2 | 12/2007 |
| JP | 2009-060966 | A | 3/2009 |
| JP | 4704429 | B2 | 6/2011 |
| JP | 4755616 | B2 | 8/2011 |
| JP | 4923081 | B2 | 4/2012 |
| JP | 5248823 | B2 | 7/2013 |

* cited by examiner

● IN CASE OF FOREFOOT STRIKER

● IN CASE OF REAR FOOT STRIKER

SHOCK ABSORBING STRUCTURE AND SHOE TO WHICH THE SHOCK ABSORBING STRUCTURE IS APPLIED

TECHNICAL FIELD

The present invention relates to a shock absorbing structure that is incorporated into a sole of a sports shoe, a running shoe or the like, for example, so as to be easily observed visually from the outside, and absorbs and alleviates (hereinafter, referred to as "absorbs shock") impact applied to a foot of a wearer at a time of landing on the ground, and particularly relates to a novel shock absorbing structure that is formed by providing a ring-shaped shock absorbing material having viscoelasticity by fitting the shock absorbing material onto an outer side of a column member that is tilted or restored in accordance with pressure reception and decompression states, and a shoe to which the shock absorbing structure is applied.

BACKGROUND ART

In many sports shoes, running shoes and the like, shock absorbing members (shock absorbing structures) are incorporated in order to absorb impacts which are applied to legs (feet, knees and the like) of those who wear the shoes. A number of research and development activities have been earnestly carried out, and various proposals have been made as such shock absorbing structures.

As shock absorbing materials having excellent shock absorbing performance as described above, structures adopting gels and rubbers (soft materials) with low hardness are known (refer to Patent Literatures 1 to 10, for example).

Since it is important to design the structure that can absorb impact to the greatest extent possible with respect to extremely large impact at a time of running and at a time of jumping, these soft materials are especially provided directly under and in vicinities of regions directly under heels, thenars and hypothenars, and therefore, most of the soft materials have been hidden inside shoe soles (or inside the soles) in general. There has been a room for improvement in the point that although the materials themselves have high shock absorbing performance, the states of the soft materials cannot be confirmed from outside, and therefore, one of the problems has been to increase the ability to attract attention as a product.

Further, there also has been the problem that the performance of the soft material cannot be sufficiently exhibited since after the soft material is sealed inside the shoe sole, a space for the soft material to deform sufficiently cannot be ensured, and the performance of the soft material is influenced by the performance of the shoe sole material.

Further, in order to enhance the shock absorbing characteristic, it is effective to increase the deformation amount of the soft material, but since deformation in the compression direction has been mainly adopted conventionally, the deformation amount has been limited in the limited thickness condition, so that there has been inevitably a limitation on improvement of the shock absorbing performance. As the shock absorbing member which practically performs a shock absorbing action is made softer, the shock absorbing characteristic is enhanced more, but when the shock absorbing member is too soft, the shock absorbing member is compressed completely at a time of pressure reception, so that bottoming occurs, or even when bottoming does not occur, a repulsion characteristic is so small that in the process from landing to kicking-out with a tiptoe, a so-called repulsion characteristic is reduced, such as excessive turning of an ankle and a deviation of the center of gravity (landing stability), and reduction in a propulsion force by a repulsive force at the time of kicking out, and therefore, there has been the problem to make a shock absorbing characteristic and performance of facilitating running and jumping compatible. Further, in the case of a viscoelastic material such as gels and rubbers, there has been generally the problem that bonding to other members is relatively difficult as the softness of the material is increased.

For the above reason, the shock absorbing structure and shoes have been pursued, which can expose a soft material to outside, in particular, expose most of the outer peripheral face to outside to the maximum extent so that presence of the soft material can attract attention of users as much as possible, and can keep performance of facilitating running and jumping while exhibiting high shock absorbing performance, at the same time. Further, there has been an increasing need for customizing shock absorbing performance on site in accordance with the feet conditions over time of a wearer (change in a running characteristic and a walking characteristic following foot podedema and fatigue).

Meanwhile, as the prior art of the structure in which a shock absorbing material is exposed to outside, there is proposed a shoe in which a column-shaped (columnar) shock absorbing material is fixedly disposed in a sole, and a periphery of the shock absorbing material is opened (refer to Patent Literature 11, for example).

However, it is not sufficient to simply expose a shock absorbing material to outside. That is, when a columnar shock absorbing material is vertically fixed between a midsole and an outer sole as in Patent Literature 11 described above, the shock absorbing material easily causes "unsteadiness" as the column bends and tilts by compression deformation, and therefore, use of a rigid resin material for the columnar member, or another support member for a periphery are required. In this way, a shock absorbing characteristic against impact in the vertical direction can be ensured more or less, but shock absorbing characteristics against a number of impacts and deformations from diagonal directions, which occur in actual use are lost.

If the columnar shock absorbing member is made of a softer material, the shock absorbing material (soft material) which is fixed between the midsole and the outer sole has deformation restricted (arrested) by the upper and lower junction faces, and therefore, there is no change in the fact that high shock absorbing performance itself which is peculiar to a soft material is significantly restricted (in particular, at a time of start of deformation).

Further, although there is proposed a shoe which is enhanced in shock absorbing performance by increasing the deformation amount by causing the soft material to undergo shearing deformation in the diagonal direction in addition to compression deformation (refer to Patent Literature 4, for example), almost no attention has been paid to bulging deformation of the soft material.

CITATION LIST

Patent Literature

Patent Literature 1: Japanese Patent Laid-Open No. 08-38211 (Japanese Patent No. 3425630)

Patent Literature 2: Japanese Patent Laid-Open No. 2009-56007 (Japanese Patent No. 5248823)

Patent Literature 3: Japanese Patent Laid-Open No. 03-170104 (Japanese Patent No. 1981297)

Patent Literature 4: Japanese Patent Laid-Open No. 2007-144211 (Japanese Patent No. 4755616)
Patent Literature 5: U.S. Pat. No. 7,877,899
Patent Literature 6: Japanese Patent Laid-Open No. 2003-79402 (Japanese Patent No. 4020664)
Patent Literature 7: Japanese Patent Laid-Open No. 2003-9904
Patent Literature 8: WO2006/120749 (Japanese Patent No. 4704429)
Patent Literature 9: Japanese Patent Laid-Open No. 2009-142705 (Japanese Patent No. 4923081)
Patent Literature 10: Japanese Patent Laid-Open No. 03-170102
Patent Literature 11: U.S. Pat. No. 5,343,639

SUMMARY OF INVENTION

Technical Problem

The present invention is made by recognizing the background as above, and addresses a problem to develop a novel shock absorbing structure capable of realizing exhibition of high shock absorbing performance peculiar to a soft material and a repulsion characteristic in a compatible manner while exposing at least most of an outer periphery of a soft material, and a shoe to which the shock absorbing structure is applied.

Solution to Problem

A shock absorbing structure is formed by including a column member, a ring member that is provided by being fitted onto the column member and has elasticity, a first pressure receiving portion that is connected to an upper end of the column member, and a second pressure receiving portion that is connected to a lower end of the column member, wherein the column member tilts with respect to at least one of the first and second pressure receiving portions with pressure reception, and is restored with decompression, and the ring member is caused to undergo bulging deformation to an outer circumferential side direction from an inner circumferential side by tilting of the column member.

Further, an action wait portion is preferably provided in at least one space of a space between the ring member and the first pressure receiving portion, and a space between the ring member and the second pressure receiving portion.

Further, compression deformation and shearing deformation by the first and second pressure receiving portions are preferably further added to the ring member, in a process of advance of bulging deformation from the inner circumferential side to the outer circumferential side direction following tilting of the column member.

Further, the column member preferably has a part that is formed in an inclined state with respect to at least one of the first and second pressure receiving portions in an initial state where no load is applied.

Further, the column member preferably has a tilt guide portion that promotes tilting at a time of pressure reception.

Further, the first and second pressure receiving portions are preferably set to be in an unparallel state in an initial state where no load is applied.

Further, the column member preferably further has a flange body that extends to an outer circumferential direction, and at least a part of the flange body is preferably embedded inside the ring member.

Further, the second pressure receiving portion is preferably a shoe sole.

Further, in at least either one of contact faces of the ring member and the column member, a ring deformation allowing space in a depressed concave shape is preferably formed.

Further, a bulging restriction portion that restricts bulging deformation of the ring member is preferably further included, and the bulging restriction portion is preferably disposed outside the ring member.

Further, at least one of the ring member and the column member is preferably configured by parts having a plurality of different materials or different properties.

Further, the column member is preferably configured by a plurality of members to be connectable in an axial direction.

Further, the ring member is preferably attached to the column member detachably and attachably.

Further, in the column member, at least any one of a convex portion, a concave portion and a constricted portion for grasping the ring member in a middle stage of the column member is preferably formed on a surface, and is provided by being fitted to the ring member.

Further, a shoe is preferably formed by incorporating a shock absorbing structure that absorbs impact that is applied to a leg of a wearer at a time of landing on a ground, into a sole, and the above described shock absorbing structure is preferably applied to the shock absorbing structure.

The shock absorbing structure is preferably disposed with a tilting direction of the column member set at a direction to guide a trajectory of a pressure center point at a time of running or walking.

Advantageous Effects of Invention

In the shock absorbing structure, the ring member is caused to undergo bulging deformation to the outer circumferential side direction from the inner circumferential side, by tilting of the column member, so that even if there is a certain time difference until the ring member receives compression by the first and second pressure receiving portions, the ring member is subjected to shearing deformation by tilting of the column member, and shock absorbing performance can be made appealing quickly (instantly).

Further, if the action wait portion is provided in the space between the ring member and at least one of the pressure receiving portions, the configuration in which compression by the first and second pressure receiving portions is further added to the column member in the process of the ring member undergoing bulging deformation in the shearing direction with tilting of the column member is made realistic.

Further, if compression deformation by the first and second pressure receiving portions and shearing deformation are further added to the column member in the process of the ring member undergoing bulging deformation to the outer circumferential side direction from the inner circumferential side with tilting of the column member, the ring member undergoes bulging deformation in a stepwise manner, and a stepwise shock absorbing action can be obtained as the shock absorbing action.

Further, if the column member has the part which is formed into an inclined state with respect to at least either one of the pressure receiving portions in the initial state, the tilting direction of the column member at the time of pressure reception is substantially specified, and intended shock absorbing performance can be faithfully reproduced.

Further, if the tilt guide portion is formed at the column member, the column member can be tilted in the specified direction more reliably at the time of pressure reception, and the intended shock absorbing performance can be reproduced more faithfully.

Further, if the first and second pressure receiving portions are set to be in an unparallel state in the initial state, a more realistic shock absorbing characteristic can be obtained. That is, the shoes at the time of landing or the like often land on the ground in an inclined state or a bent state with the tiptoe sides facing slightly upward, and the shoes hardly descend downward straightly while the entire shoes keep the horizontal state. Consequently, making the first and second pressure receiving portions unparallel in accordance with the installation position of the shock absorbing structure, the habit of walking of the wearer, the way of application of load, and the like can provide a more realistic shock absorbing characteristic.

Further, if the first and second pressure receiving portions are made unparallel, the opening portion sandwiched by the first and second pressure receiving portions is not constant throughout an entire circumference, a bulging amount (protruded amount) of the ring member becomes larger at a wide angle opening side having a large opening portion, and an interest from an external appearance can be obtained.

Further, if the first and second pressure receiving portions are made unparallel, when the first pressure receiving portion is disposed at an upper side, for example, a junction portion of the first pressure receiving portion and the column member can be provided at a position higher than a ground contact face (a face where a foot bottom face contacts the sole) of a foot, and the column member can exhibit a shock absorbing characteristic while contributing to stability at the time of landing.

Further, if the flange body which extends to the outer circumferential direction is formed in the column member, and at least a part of the flange body is embedded inside the ring member, the flange body compresses (presses) the ring member at the time of pressure reception, and can promote bulging deformation of the ring member. Further, the flange body prevents slide of the column member which tilts at the time of pressure reception and a column reception hole of the ring member, can efficiently convert the tilting of the column member into deformation of the ring member, and can cause the ring member to undergo bulging deformation reliably.

Further, if the second pressure receiving portion is disposed at the lower side, and the second pressure receiving portion is further formed on the shoe sole, the shock absorbing structure can be configured to be simple, and reduction in weight of the shock absorbing structure, and reduction in weight of the shoe by extension can be realized.

Further, if the ring deformation allowing space is formed in either one or both of the ring member and the column member, the ring deformation allowing space functions as the deformation space for the ring member when the ring member undergoes bulging deformation by pressure reception, can promote bulging deformation of the ring member, and can enhance shock absorbing performance as the shock absorbing structure.

Further, if the bulging restriction portion is provided outside the ring member, bulging deformation of the ring member at the time of pressure reception is restricted in a proper site, and bulging deformation of the ring member, and the shock absorbing performance of the shock absorbing structure by extension, can be controlled and adjusted. Further, the bulging restriction portion also functions as prevention of falling from the pressure receiving portion for the ring member.

The material, the shape, the dimension, the number and the like of the bulging restriction portion can be properly set depending on how the ring member is deformed or the like at the time of pressure reception.

Further, if at least one of the ring member and the column member is configured by the parts having a plurality of different materials or different properties, development of variations having more various shock absorbing performances can be realized.

Further, if the column member is configured by a plurality of members to be connectable in the axial direction, development of variations having more various shock absorbing performances can be realized.

Further, if the ring member is attached to the column member detachably and attachably, when the shock absorbing structures are provided in the shoes, for example, a user can select the ring members of the materials that are to his or her taste and can replace the ring members with the selected ring members after purchasing the shoes, so that the functions more suitable for the users, such as finding out the shock absorbing characteristics suitable for unique arrangement, running forms of their own and the like can be provided. That is, by making the ring members attachable and detachable, the ring members can be replaced with the ring members with different hardness, shapes, colors and the like to customize the ring members in accordance with preference and an object of a wearer (a user).

Further, if the structure is such that the convex portion, the concave portion or the constricted portion for grasping the ring member in the column middle stage is formed on the surface of the column member, and is connected to the ring member by being fitted, the ring member can be reliably fixed to the column member, the disposing position of the ring member can be made at will, and development of variations of various shock absorbing functions can be realized.

Further, the shoe that prevents bottoming while enhancing a shock absorbing characteristic, and is given a repulsion characteristic can be provided.

Further, if the tilting direction of the column member is set at a direction corresponding to the trajectory of the pressure center point at the time of running or walking, the shock absorbing structure can contribute to smooth guidance of the pressure center point, in addition to absorption of impact at a time of running or walking.

DESCRIPTION OF EMBODIMENTS

Modes for carrying out the present invention include what will be described in the following embodiments as some of the modes, and also further include various methods that can be improved within the technical idea of the present invention.

Embodiments

Figure 1:
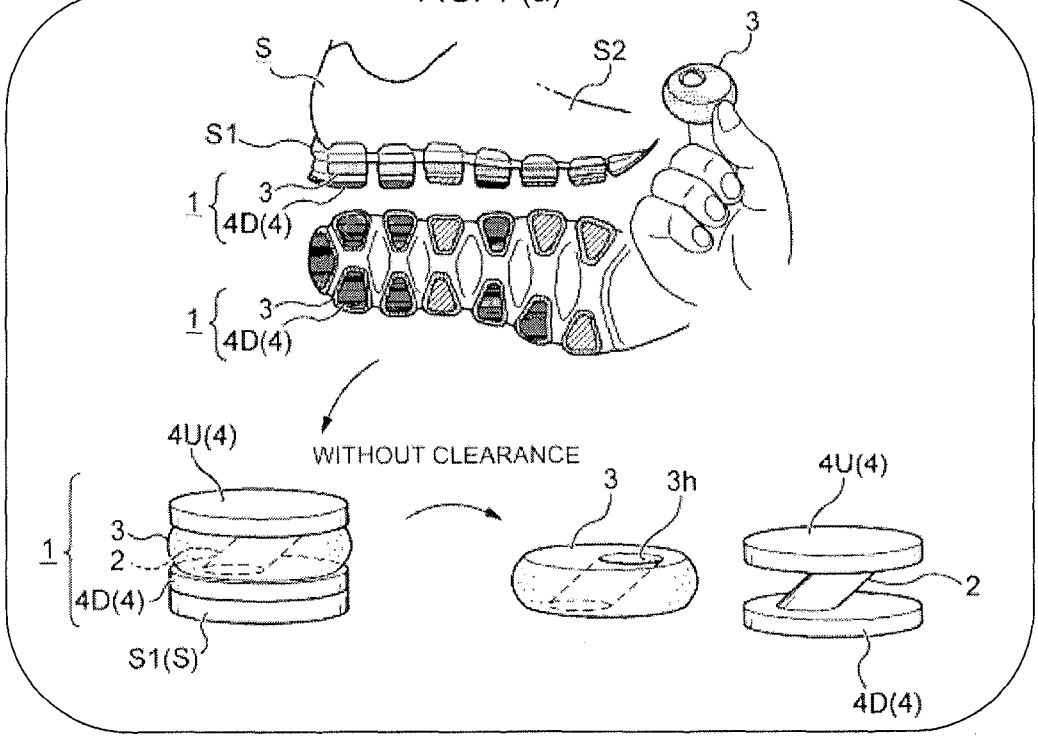
FIG. 1 shows an explanatory view partially showing an example of a shoe to which a shock absorbing structure of the present invention is applied and only the shock absorbing structure, and perspective views separately showing a ring member and a column member (including an upper and lower pressure receiving portions) that configure the shock absorbing structure (a), sectional views showing configuration examples having clearances (action wait portions) (b) and (c), and a sectional explanatory view showing a deformation mode of the shock absorbing structure at a time of pressure reception in a stepwise manner (d).
Figure 1:
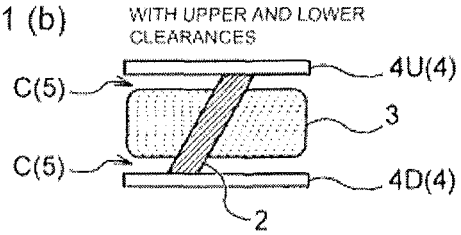
Figure 1:
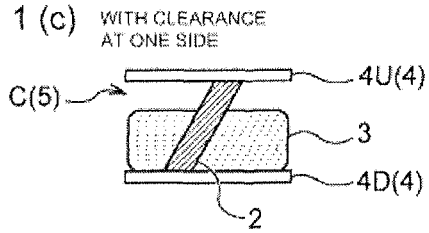
Figure 1:
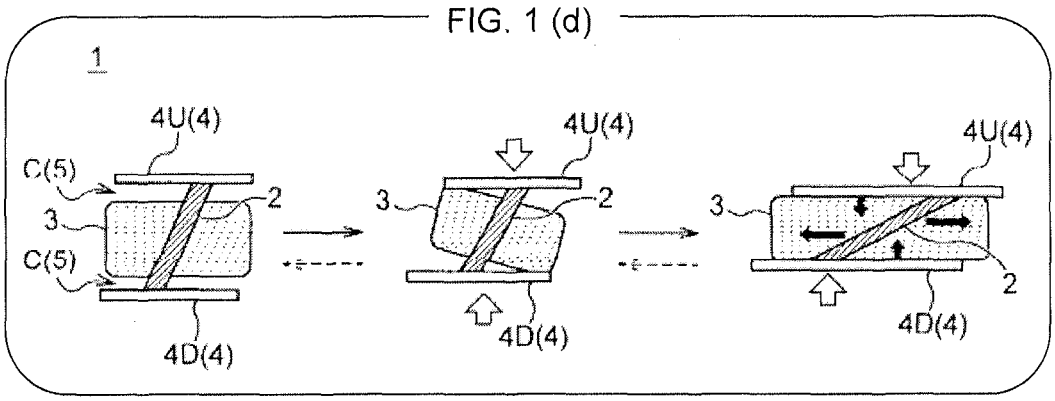

A shock absorbing structure 1 of the present invention is provided in footwear such as a shoe S, for example, as shown in FIG. 1 (*a*) as an example, and the shock absorbing structure 1 absorbs impact that is applied to a leg of a person (a wearer) wearing the shoe S, and also enables impact which is not absorbed to be smoothly converted into a kicking-out motion of a foot, as a repulsive force. Here, in the present embodiment, as a product in which the shock absorbing structure 1 is provided, a shoe (sports shoe) S is mainly shown, but as footwear other than this, sandals and the like are also cited, for example. The shock absorbing structure 1 of the present invention can be, as a matter of course, applied to products other than footwear, and are also applicable to supporters, protectors and the like which athletes wear to protect joints and the like, for example.

Hereinafter, the shoe S in which the shock absorbing structure 1 is provided will be described first.

As shown in FIG. 1 (*a*) described above, the shoe S is formed by joining an upper S2 which covers an instep of a foot or the like to a sole S1 to be a ground contact part. A single or a plurality of the above described shock absorbing structures 1 is or are provided on a bottom face or the like of the sole S1, for example.

Note that when the shock absorbing structure 1 is provided in the shoe S, it is desired that the shock absorbing structure 1 itself is installed so as to be visible from outside as much as possible for the purpose of making shock absorbing performance strongly appealing, and from a viewpoint of improvement in design or the like, and for this purpose, FIG. 1 described above also illustrates a mode in which the shock absorbing structures 1 are attached to a substantially entire outer peripheral edge of the bottom face of the sole S1 (the shoe S). However, when the shock absorbing structures 1 are provided in the sole S1, the shock absorbing structures 1 may be installed so as not to be visually observed, and although not illustrated, such a configuration may be adopted that a reception space that accommodates the shock absorbing structures 1 is formed inside the sole S1 in advance, for example, and after the shock absorbing structures 1 are accommodated in the reception space, the reception space is closed with a translucent member (a transparent member) to make the shock absorbing structures 1 visible from outside.

In this connection, many users actually touch the shock absorbing structures 1 as above, in particular, the ring members 3 with hands and fingers (refer to FIG. 1) when purchasing the shoes S, and even when the shock absorbing structures 1 need to be provided at only the parts which functionally require the shock absorbing structures 1, the desires of the users to buy products are more stimulated by the products in which the shock absorbing structures 1 are provided on the entire bottom faces.

Hereinafter, the shock absorbing structure 1 will be described. Note that in the present description, explanation will be made basically on the assumption of a case where the shock absorbing structures 1 are provided in the shoe S.

While the shock absorbing structure 1 has a main object to absorb impact when an impact compression load is applied (at a time of pressure reception), the shock absorbing structure 1 is configured to smoothly shift an impact force that is not absorbed to a kicking-out motion of a foot of a wearer as a repulsive force, at a proper stage in which the shock absorption advances (before the shock absorbing material causes a bottoming phenomenon, for example).

The shock absorbing structure 1 includes a column member 2 that is provided by being raised obliquely in an initial state (a no-load state) where no load is applied, and a ring member 3 that is provided by being fitted onto an outer side of the column member 2 as main components as is also shown in FIG. 1 (*a*) as an example. Further, the shock absorbing structure 1 includes first and second pressure receiving portions 4U and 4D (hereinafter, the first and second pressure receiving portions 4U and 4D may be simply referred to as "pressure receiving portions") at both upper and lower ends of the column member 2. Consequently, the upper and lower pressure receiving portions 4U and 4D have a structure connected by the column member 2.

Further, as shown in FIGS. 1 (*b*) and (*c*) as examples, in the present embodiment, a clearance C (a kind of action wait portion 5 that will be described later) may be provided in at least one of spaces between the ring member 3 and the upper and lower pressure receiving portions 4U and 4D.

Next, an outline of a shock absorption process of the shock absorbing structure 1 will be described.

Explanation will be made with a configuration in which the clearance C is provided as an example first. When the clearance C is provided in the shock absorbing structure 1, the shock absorption process is formed mainly by three stages of a first deformation stage, a second deformation stage and a restoration stage.

When the shock absorbing structure 1 receives pressure, the column member 2 tilts, and the ring member 3 rolls. When the ring member 3 contacts a part of the pressure receiving portion 4, the ring member 3 starts bulging deformation to an outer circumferential side from an inner circumferential side (the first deformation stage). Subsequently, the deformation stage reaches the second deformation stage in which deformation caused by the ring member 3 being compressed by being sandwiched by the upper and lower pressure receiving portions 4, and deformation by tilting of the column member 2 act compositely (the second deformation stage). Thereafter, a decompression state is brought about, and the process at the time of pressure reception is returned oppositely by restoration from deformation of the ring member 3 and tilting of the column member 2 (the restoration stage). By a cycle configured by the series of processes, a peculiar shock absorbing characteristic and repulsion characteristic by the present configuration are exhibited.

Meanwhile, in a case of a configuration without the clearance C shown in FIG. 1 (*a*), the peculiar shock absorbing characteristic and repulsion characteristic by the present configuration are exhibited by a cycle configured by the second deformation stage and the restoration stage without going through the first deformation stage.

Furthermore, with a configuration in FIG. 1 (*b*) as an example, a shock absorption process of the shock absorbing structure 1 will be described more specifically with use of FIG. 1 (*d*) that skeletally shows respective deformation strokes of the above described cycle of the shock absorbing structure 1.

The first deformation stage: as the column member 2 tilts in an inclination forming direction first with pressure reception, a position of the ring member 3 rolls, and parts of upper and lower faces of the ring member 3 contact the pressure receiving portion 4U and/or the pressure receiving portion 4D. When the ring member 3 contacts the pressure receiving portion 4, the ring member 3 starts shearing deformation from an inside by the column member 2. Although FIG. 1 (*d*) shows an example in which diagonal side end portions of the upper and lower faces of the ring member 3 simultaneously contact the pressure receiving portions 4U and 4D, the respective side end portions may start contact at different timings, or only one side may contact. Further, in the case of FIG. 3 (*b*), the ring member 3 undergoes shearing deformation by tilting of the column member 2 before contacting the pressure receiving portions 4. By difference in the configuration of the shock absorbing structure 1, the deformation process of the first deformation stage can be arranged in this way. Deformation resistance (the repulsion characteristic) of the ring member 3 performs an action of controlling behaviors of tilting and restoration of the column member 2.

The second deformation stage: the second deformation stage is a stage in which while tilting of the column member 2 advances, the ring member 3 is sandwiched by the upper and lower pressure receiving portions 4U and 4D, and compression deformation and shearing deformation accompanying the above are added. In other words, the second deformation stage is the stage in which an action of directly compressing the ring member 3 is further added by the upper and lower pressure receiving portions 4U and 4D to the shearing deformation action of the ring member 3 in the first deformation stage. At this time, the ring member 3 undergoes bulging deformation to the outer circumferential side direction. Further, as represented by FIG. 1 (*d*), when the facing positions of the pressure receiving portion 4U and the pressure receiving portion 4D relatively move parallel in the opposite directions with advance of tilting of the column member 2, shearing stress also acts onto the ring member 3 from outside, and the ring member 3 receives shearing deformation compositely from inside and outside. In addition, by the aforementioned parallel movement or slide movement of the pressure receiving portions, the shock absorbing structure 1 also functions as the shock absorbing structure 1 which also has a guide action that guides movement of the foot of a wearer, in association with the shock absorbing characteristic.

The decompression stage: the decompression stage is a stage of returning in a flow which is opposite to the process from the above described first deformation stage to the second deformation stage, with the repulsive force which is accumulated in the ring member 3 and the column member 2 in the first deformation stage to the second deformation stage.

In the above described shock absorbing process, movement in the vertical direction in the upper and lower pressure receiving portions 4U and 4D accompanying pressure reception is movement of the upper pressure receiving portion 4U approaching the lower pressure receiving portion 4D (movement of a space between both the upper and lower pressure receiving portions being gradually narrowed), and an action of compressing the column member 2 and the ring member 3.

Note that FIG. 1 (*d*) shows that a positional relationship of the upper and lower pressure receiving portions 4U and 4D is kept parallel with respect to pressure reception, but when the pressure receiving portions 4U and 4D receive impact and pressure from oblique directions with respect to faces of the pressure receiving portions 4U and 4D, deformation may be in such a manner that either one of the pressure receiving portions 4U and 4D inclines. Furthermore, the pressure receiving portions 4 may be designed to be capable of inclining with tilting of the column member 2, with respect to the impact from an oblique direction like this, and in this case, a strong compression part can be formed to the inclined face side.

Furthermore, if clearance adjustment is performed as described later, timing or the like for shifting to the second deformation stage from the first deformation stage can be properly adjusted. Especially when the clearances C are provided at both a top and bottom of the column member 2, the shock absorbing structure 1 having more various shock absorbing characteristics and repulsion characteristics can be designed by generating a timing for shifting to the second deformation stage from the first deformation stage stepwise or the like by using the difference of the upper and lower clearances C.

Further, if a part of the pressure receiving portion 4U at the upper side is configured to be rolled up to a portion (a side face portion of a foot) higher than a ground contact face of a foot (a face where a foot sole contacts the sole), unsteadiness of the foot at a time of landing is restrained, and contribution can be made to enhancement in stability.

Next, an estimated shock absorbing mechanism of the shock absorbing structure 1 of the present embodiment will be described as a case of the shock absorbing structure 1 being applied to the shoe S with FIG. 1 (*d*) as an example.

The shock absorbing structure 1 absorbs impact energy in a stroke from deformation that occurs after a runner (a wearer) lands the foot on the ground until the runner kicks out to restoration, and absorbs shock. In the stroke from the deformation to restoration, a relationship between a deformation amount and a force generated in the shock absorbing structure 1 forms a hysteresis loop illustrated in FIG. 20(*a*), and a region enclosed by the hysteresis loop corresponds to the absorbed energy. More specifically, the aforementioned hysteresis loop goes through deformation strokes of the shock absorbing structure 1 in 1) to 4) as follows, and returns to the shape of the shock absorbing structure 1 before deformation. That is:

1) deformation stroke A: a stroke in which a bottom face lands on the ground, the pressure receiving portion 4 receives an impact compression load and the column member 2 independently tilts, 2) deformation stroke B: a stroke in which the ring member 3 deforms while the ring member 3 partially contacts the pressure receiving portion 4 by tilting of the column member 2, 3) deformation stroke C: a stroke in which the ring member 3 is subjected to compression deformation by the pressure receiving portion 4, in addition to deformation by tilting of the column member 2, and 4) deformation stroke D: a deformation stroke in which load decreases as the foot moves away from the ground, and the shape of the shock absorbing structure 1 is to be restored.

The above described deformation stroke A and deformation stroke B correspond to the first deformation stage, the deformation stroke C corresponds to the second deformation stage, and the deformation stroke D corresponds to the restoration stage, respectively.

Note that the deformation stroke A is not accompanied by deformation of the ring member 3, and therefore the hysteresis is formed by the deformation strokes B to D accompanied by deformation of the ring member 3.

Figure 20:
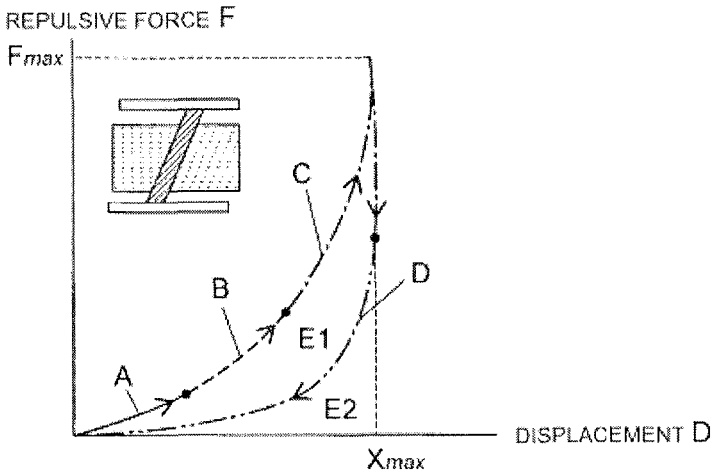
FIG. 20 shows explanatory diagrams each showing a shock absorbing characteristic and a repulsion characteristic by a shock absorbing structure.
Figure 20:
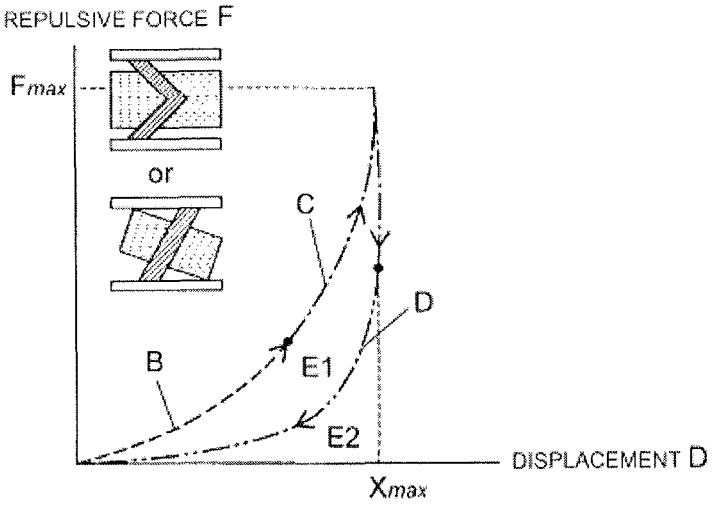
Figure 20:
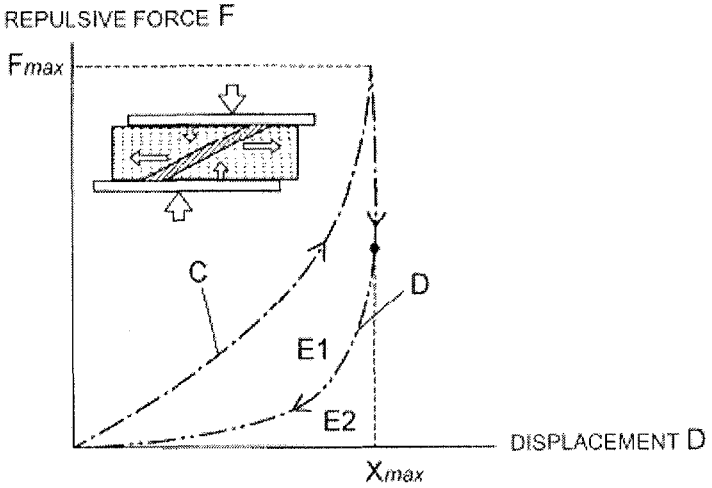

Here, in FIG. 20 (*a*), an area E1 enclosed by the deformation strokes B, C and D is the energy absorbed by the shock absorbing structure 1, and an area E2 enclosed by the deformation stroke D and a displacement axis represents energy which is not absorbed by the shock absorbing structure 1, that is, repulsion energy. The shock absorbing structure 1 having the large area E1 has a large shock absorbing characteristic, but hardly exhibits a repulsion characteristic, and is easily bottomed. Further, the shock absorbing structure 1 having the large area E2 is favorable for a countermeasure against bottoming, but has a large repulsion characteristic, and therefore, a shock absorbing effect cannot be expected. That is, the shock absorbing structure 1 in which the areas E1 and E2 are generated in a well-balanced manner is preferable as a shoe part.

Figure 3:
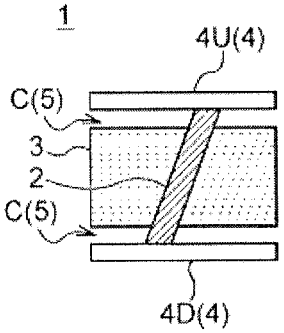
FIG. 3 shows explanatory views showing various shape variations of the column member.
Figure 3:
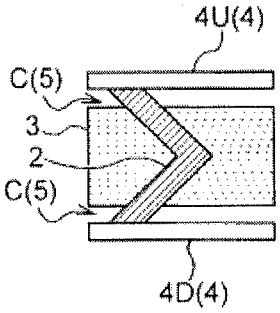
Figure 3:
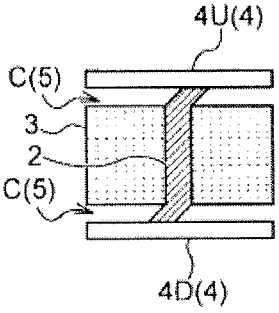
Figure 3:
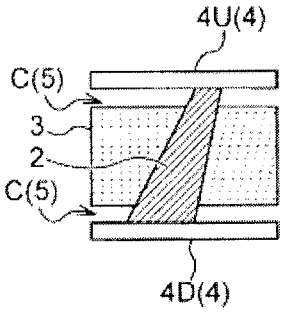
Figure 3:
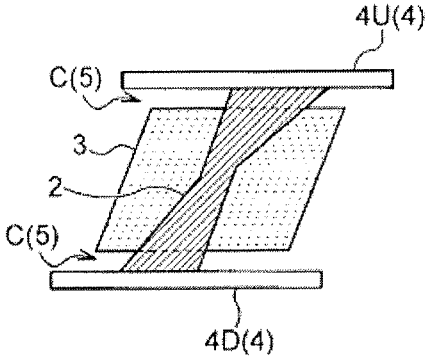
Figure 3:
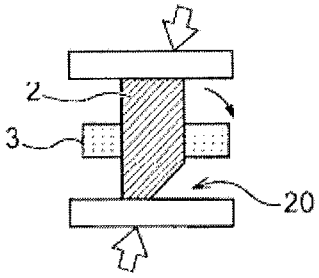

Further, in the shock absorbing structure 1 shown in FIG. 3 (*b*), the ring member 3 undergoes shearing deformation by tilting of the column member 2 before the ring member 3 contacts the pressure receiving portion 4. In the configuration like this, the deformation stroke A in which only the column member 2 deforms is not present, and the hysteresis loop is configured by the deformation strokes B to D accompanied by deformation of the ring member 3, as shown in FIG. 20 (*b*). In the shock absorbing structure 1 in which the corner portion of the ring member 3 contacts the pressure receiving portion 4 in the initial state, the deformation stroke A is not generated at the time of pressure reception, either.

Further, when the clearance C is not configured in the shock absorbing structure 1, a hysteresis loop is configured by the deformation strokes C and D as in FIG. 20 (*c*).

Next, a formation process of the aforementioned hysteresis in the shock absorbing structure 1 of the present invention will be described. First, in the first deformation stage, the ring member 3 undergoes shearing deformation while the column member 2 tilts (the deformation stroke A to the deformation stroke B), and the magnitude of the repulsive force which is generated in accordance with the physical properties of the materials, shapes and dimensions of the column member 2 and the ring member 3, that is, the gradients of the deformation strokes A and B with respect to a displacement, change.

When the process shifts to the second deformation stage (the deformation stroke C) subsequently, the column member 2 and the ring member 3 compositely generate a repulsive force by the pressure receiving portion 4, and a gradient of the deformation stroke C with respect to a displacement changes in accordance with the physical properties of the materials, shapes and dimensions of the column member 2 and the ring member 3.

When the force which deforms the shock absorbing structure 1 is removed thereafter, the process shifts to the restoration stage, where a repulsive force response to a displacement, that is, a route of the deformation stroke D, is determined according to shape deformation of the column member 2 and the ring member 3, an apparent increase amount of modulus of elasticity by deformation restriction of the column member 2 and the ring member 3, and the physical properties of the materials, shapes and dimensions of the column member 2 and the ring member 3, and a shock absorbing characteristic and a repulsion characteristic corresponding to the areas E1 and E2 of the hysteresis loop in the relationship between the deformation amount and the force generated in the shock absorbing structure 1 are exhibited.

The shock absorbing structure 1 of the present invention is configured as described above, whereby in the shock absorbing process, adjustment of suppression of the compression deformation amount and timing for increase of the repulsive force (adjustment of the shapes and the gradients of the loop of the deformation strokes B and C in FIG. 20) can be achieved while keeping balance with the shock absorbing characteristic (E1), and therefore, coexistence of an excellent shock absorbing characteristic and repulsion characteristic is realized while bottoming is prevented. Note that, in the first deformation stage and the second deformation stage, the shock absorbing performance can be changed properly by changing configuration conditions.

Hereinafter, the column member 2, the ring member 3 and the pressure receiving portion 4 which configure the shock absorbing structure 1 will be further described.

First, the column member 2 will be described.

The column member 2 connects the upper and lower pressure receiving portions 4U and 4D, and the column member 2 itself tilts by pressure reception, but when the load is removed, the column member is restored to the initial state. Here, as for restoration at the time of removal of the load, the column member 2 itself does not necessarily have to be restored positively, but may be structured to be restored by using elasticity of the ring member 3, for example. The column member 2 causes the ring member 3 to undergo bulging deformation to the outer circumferential side direction by tilting of itself, and when tilting, deformation of the column member 2 itself bending or curving (buckling) may be accompanied.

Although the material of the column member 2 is not specially limited, the column member 2 is configured from a material that does not cause (or extremely hardly causes) deformation that simply reduces the height dimension at the time of pressure reception, or compression deformation that decreases the volume, for example. More specifically, application of a molded product of a synthetic resin is realistic. As the aforementioned synthetic resin, a non-foamed resin such as a polyether block amide copolymer (for example, PEBAX (registered trademark)), an urethane resin, a nylon resin and a polyester resin is preferable. Further, even a foamed material such as EVA may be usable as the material of the column member 2 if the foamed material is processed to be so hard that deformation hardly occurs, by performing thermal pressing or the like.

Here, as shown in FIG. 1 described above as an example, the column member 2 of the present embodiment is preferably already formed into an inclined state from the initial state where no load is applied, and is configured to tilt further in the inclination forming direction by pressure reception.

Note that a connection mode of the column member 2 and the pressure receiving portions 4U and 4D will be described later.

Further, the column member 2 is such that an angle (a smaller angle: an upper limit of 89 degrees) formed by a center axis and the pressure receiving portion 4 (in particular, the lower side pressure receiving portion 4D in this case) is set at five degrees or more (desirably 15 degrees or more, more desirably 45 degrees or more) in the initial state.

Here, the column member 2 tilts so as to decrease the angle which is formed by the pressure receiving portion 4 (the lower side pressure receiving portion 4D) and the column member 2 which is formed obliquely to the pressure receiving portion 4 (this is referred to as "(tilt in) the inclination forming direction" in the present description), and therefore, setting the inclination angle of the column member 2 in the initial state determines a height difference of the upper side pressure receiving portion 4U (an approaching dimension of the upper and lower pressure receiving portions 4U and 4D), and a slide dimension in the horizontal direction of the upper side pressure receiving portion 4U (the height difference and the slide dimension also differ depending on the properties such as hardness of the ring member 3).

Note that although in the present description, many column members 2 which form circular column shapes are shown as the column members 2, the shape of the column member 2 is not always limited to the circular-column shape. If a rectangular column or a plurality of columns is adopted, for example, a direction in which the column member easily tilts can be set as will be described later. Further, the sectional shape also can be formed into various shapes, besides a circular shape.

Since as the angle of the column member 2 is smaller, a movable range (a stroke) in which the column member 2 tilts becomes smaller, the thickness (height) of the ring member 3 which is provided by being fitted onto the column member 2 becomes small, and accordingly a sufficient shock absorbing characteristic is difficult to obtain when the angle of the column member 2 is smaller than the above described lower limit of the angle.

Further, as the angle is smaller, the tilting direction is limited more, and the angle around 90 degrees is effective for a design having the degree of freedom in the tilting direction.

Next, the ring member 3 will be described.

The ring member 3 is an elastic member that is provided by being fitted onto the outer side of the column member 2, and is more specifically formed from a member that has a smaller modulus of elasticity and is more deformable than the column member 2 and the pressure receiving portions 4U and 4D. The ring member 3 is pressed to the outer circumferential direction by being accompanied by shearing deformation from the inner circumferential side by tilting of the column member 2, and undergoes bulging deformation to the outer circumferential direction. Further, in the aforementioned second deformation stage in which the ring member 3 is sandwiched and compressed by the upper and lower pressure receiving portions 4U and 4D, the ring member 3 causes bulging deformation toward the outer circumferential direction with the shearing deformation by tilting of the column member 2 combined. Conversely, with decrease of the shearing stress by tilting of the column member 2 and compression stress by the upper and lower pressure receiving portions 4U and 4D, the ring member 3 is restored by impact resilience of itself, and returns to the initial state when the stress is completely removed.

The ring member 3 performs a shock absorbing action of absorbing impact by deformation and restoration, and also functions to restrict the tilting movement of the column member 2 which is located at the inner circumferential side of the ring member 3 and restore tilting of the column member 2 as described above. Further, as a material of the ring member 3, the ring member 3 may be formed from any material as long as the ring member 3 is softer than the column member 2 and the pressure receiving portions 4 as described above, and various rubber materials and gel materials, or foams (for example, EVA or the like) of these materials are applicable, for example. The material properties such as hardness and extension properties can be selected in accordance with the performance of the shock absorbing structure 1.

Note that in the ring member 3 shown in FIG. 1 (*b*), the clearances C are formed between the ring member 3 and the upper and lower pressure receiving portions 4U and 4D, in the initial state where no load is applied. That is, the height ("an effective working height" which will be described later) of the ring member 3 is formed to be smaller than the height of the column member 2.

Here, a hole which is formed in the ring member 3, that is, a hole for passing the column member 2 through is referred to as a column reception hole 3*h*, and is formed (opened) obliquely along the inclination of the column member 2 in FIG. 1 (*b*).

Further, on the assumption that the ring member 3 which is once fitted onto the column member 2 is not detached, that is, in a case where replacement of the ring member 3 is not performed (in the case of being on the assumption of non-replacement), the ring member 3 may be bonded and fixed to the column member 2.

Meanwhile, when the ring member 3 is not bonded to the column member 2, but is made replaceable, an arbitrary combination can be adopted. For example, a hole diameter of the ring member 3 (the column reception hole 3*h*) is made smaller than the outside diameter of the column member 2 (a so-called "close fit"), and the ring member 3 may be firmly held by the column member 2 by using a fastening force of the ring member 3 itself at the time of the ring member 3 being fitted onto the column member 2. This state is a state in which stress bias is applied to both the ring member 3 and the column member 2, and the state can be properly adjusted by a hole diameter dimension of the ring member 3 (the column reception hole 3*h*), for example, whereby various shock absorbing characteristics can be obtained.

Further, when the hole diameter of the ring member 3 (the column reception hole 3*h*) is made larger than the outside diameter of the column member 2, a shock absorbing characteristic can be obtained according to a gap state between an inner circumferential face of the ring member 3 (the column reception hole 3*h*) and an outer circumferential face of the column member 2. The hole diameter of the ring member 3 (the column reception hole 3*h*) and the outside diameter of the column member 2 may be made the same as a matter of course.

As a method for making the ring member 3 detachable and attachable, the ring member 3 is made detachable by providing an incision slit that extends from the ring member outer periphery to a center hole, and sectional junction faces after fitted can be separated, or the ring member 3 can be made detachable and attachable from and to the slit while rotating the ring member 3 by forming the aforementioned slit into a spiral shape.

Note that by making the ring member 3 replaceable, performance such as a shock absorbing characteristic, a repulsion characteristic, and a pronation characteristic can be adjusted on site in accordance with a change in conditions of feet over time by hard running and walking for a long time, such as a long distance marathon, and a triathlon, for example. Further, new development, interest and the like can be also provided to a user, such as enjoyment of unique arrangement by a user selecting the ring member 3 which meets a taste of the user (a sense of enjoying fashion) after purchase, and enjoyment of finding out multiple-stage shock absorbing characteristics unique to the user.

Next, the pressure receiving portion 4 will be described.

Figure 2:
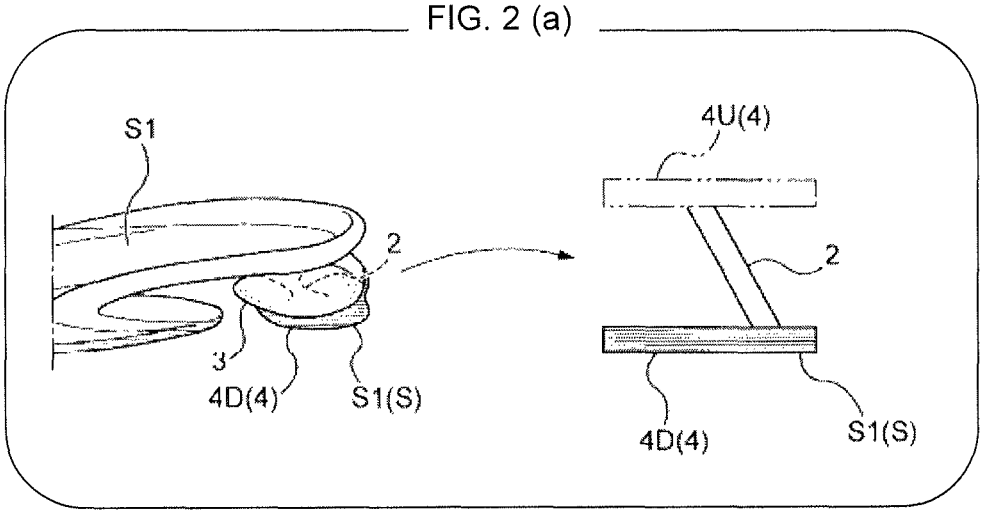
FIG. 2 shows a perspective view showing a part of a shoe having lower side of a second pressure receiving portion as an outsole (shoe sole), and a shock absorbing structure (except for a ring member) at this time (a), and an exploded perspective view of a shock absorbing structure in which upper and lower first and second pressure receiving portions and a column member are integrally formed (b).
Figure 2:
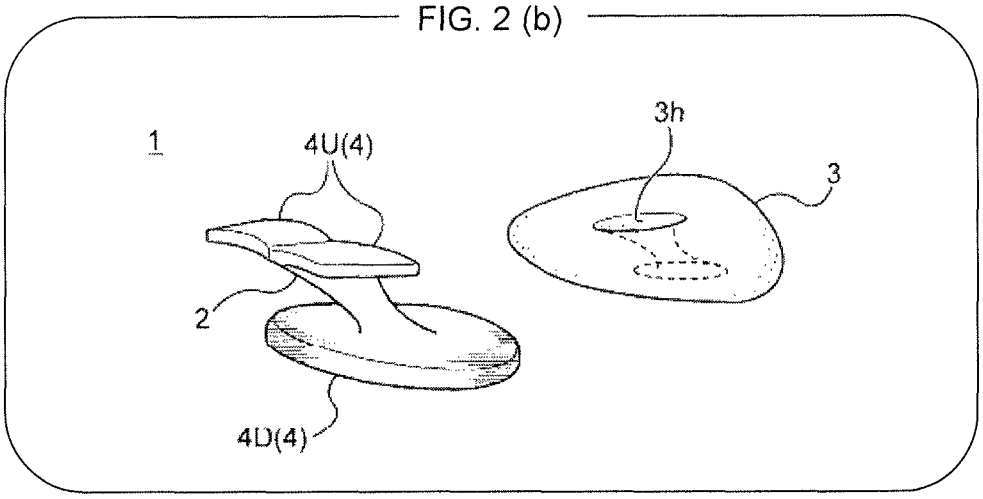

The pressure receiving portion 4 is a part that transmits the load (load) at the time of pressure reception to the column member 2 and the ring member 3, and can be configured to be formed as a member totally different from the sole S1 such as a midsole and an outer sole in the shoe S, or a part of the sole S1 may be configured as the pressure receiving portion 4, as shown in FIG. 2, for example. Here, FIG. 2 shows a mode in which the lower side pressure receiving portion 4 is made a heel portion (a part) of the shoe S, and simplification of the shock absorbing structure 1, reduction in weight of the shoe S, and the like can be realized by the configuration.

When the pressure receiving portion 4 is formed as a part of the sole S1, the material of the pressure receiving portion 4 is the same as the material of the sole S1 as a matter of course, and even when the pressure receiving portion 4 is formed as a member that is attached to the sole S1, the pressure receiving portion 4 may be formed from the same material as the material of the sole S1. Note that when the pressure receiving portion 4 is formed from a material totally different from the material of the sole S1, a resin material or the like that is harder than the sole S1 is preferably applied, for example.

Further, the materials (combination) of the column member 2 and the pressure receiving portion 4 are properly selected in accordance with an object, and the column member 2 and the pressure receiving portion 4 may be formed from the same material, or may be formed from different materials.

Further, when the column member 2 and the pressure receiving portion 4 are formed as separate members, regardless of whether the materials are of different kinds or the same kind, the column member 2 and the pressure receiving portion 4 can be bonded to each other after formation. As a matter of course, productivity can be enhanced when the column member 2 and the pressure receiving portion 4 are integrally formed from the beginning, and a risk of occurrence of peeling in the case where the column member 2 and the pressure receiving portion 4 are formed as separate members and bonded to each other can be eliminated (that is, bonding strength is ensured).

When the column member 2 and the pressure receiving portion 4 are integrally formed, multicolor injection molding or the like can be applied, and is also preferable when the column member 2 and the pressure receiving portion 4 are desired to be integrated with the sole S1. Incidentally, the shape of the pressure receiving portion 4 is not necessarily limited to a thin plate shape (a disk shape), but as also shown in FIG. 2(*b*), for example, the pressure receiving portion 4, in particular, the upper side pressure receiving portion 4 may be formed into a fork shape. Here, in FIG. 2 (*b*), the pressure receiving portion 4 and the column member 2 are integrally formed. When the ring member 3 is provided by being fitted onto the column member 2, the fork-shaped upper side pressure receiving portion 4 is closed, and after the ring member 3 is provided by being fitted, the upper side pressure receiving portion 4 is returned into a fork-shaped state. As a matter of course, the shock absorbing structure can be fitted to the shoe S (for example, a heel portion) by using the shape of the fork-shaped upper side pressure receiving portion 4 like this.

Further, in the present embodiment, a clearance C is formed between the ring member 3 and the pressure receiving portion 4 in the initial state where no load is applied as described above (refer to FIG. 1 (*b*)). At the time of pressure reception, the column member 2 tilts first, and from a time point when a part of the ring member 3 contacts the pressure receiving portion 4 by the tilt, the column member 2 causes the ring member 3 to undergo shearing deformation from the inner circumferential side to push the ring member 3 to the outer circumferential side direction to cause the ring member 3 to undergo bulging deformation to the outer circumferential side direction. Further, a structure may be adopted, in which a part of the ring member 3 contacts the pressure receiving portion 4, a midsole and the like in a no-load state, and in this case, shearing deformation of the ring member 3 can be started at the same time as the load is exerted. The bulging deformation of the ring member 3 (bulging deformation by tilting of the column member 2) continues until the upper and lower pressure receiving portions 4U and 4D are close to each other and the clearance C disappears seemingly, and thereafter the received pressure load directly acts on the top and bottom faces of the ring member 3 so that the ring member 3 undergoes bulging deformation with which the compression deformation is combined. In this way, a certain time difference (an action wait time) is generated from start of pressure reception until the entire top and bottom faces of the ring member 3 are directly compressed by the upper and lower pressure receiving portions 4U and 4D. Therefore, a wait region (region until start of direct bulging deformation by pressure reception) of the ring member 3 like this is made an action wait portion 5, and in the present embodiment, the clearance C corresponds to the action wait portion 5. In other words, the action wait portion 5 (the clearance C in this case) like this is present, and thereby the ring member 3 undergoes stepwise bulging deformation. Further, as represented by FIG. 3 (*b*), when the ring member 3 undergoes shearing deformation by only tilting of the column member 2 before the ring member 3 contacts the pressure receiving portion 4, the aforementioned stepwise deformation action is similarly exhibited by configuring the clearance C.

The action wait portion 5 is not necessarily limited to the clearance C which is provided between the ring member 3 and the pressure receiving portion 4, and this will be described later.

Other Embodiments

Although the present invention has the embodiments described above as a basic technical idea, modifications as follows may be further made.

First, in each of the aforementioned embodiments, as shown in FIG. 3 (*a*) as an example, the column member 2 is shown, which is provided by raising a column body with a substantially constant diameter size in an obliquely straight state, but as shown in FIG. 3 (*b*), for example, the column member 2 may be in a mode in which a column body with a substantially constant diameter size is formed to be bent (or formed to be curved) into a chevron shape in side view, or besides, as shown in FIG. 3 (*c*), for example, the column member may be in a mode in which the column body with a substantially constant diameter thickness is formed in a substantially straight state in a vicinity of a central portion while the column body is inclined in vicinities of both upper and lower ends (vicinities of the pressure receiving portions 4).

Further, as shown in FIG. 3 (*d*), for example, the column member 2 may be in a mode in which a column body with a diameter size becoming smaller toward the upper side is provided to be raised obliquely, and if a middle stage of the column member 2 is formed into a constricted shape, the ring member 3 provided by being fitted onto the column member 2 can be prevented from slipping down as shown in FIG. 3 (*e*), for example. A shape for preventing slipping-down of the ring member 3, that is, for reliable fixation of the ring member 3 to the column member 2 is not necessarily limited to the constricted shape as described above, but may be a concave portion and a convex portion.

Further, if the column member 2 is a part that receives impacts from obliquely above and below, for example, a mode may be adopted, in which while a column body such as a circular column is vertically provided substantially straightly, the column body is made a solid body with a part of a lower end edge thereof being cut out (this will be referred to as a cutout 20), as shown in FIG. 3 (*f*). In this case, the column member 2 receiving pressure tilts to fall down to the cutout 20.

As the column member 2, various shapes (modes) can be adopted in this way, and especially from FIGS. 3 (*c*), (*f*) and the like, the column member 2 does not necessarily have to be inclined from the initial state, but may tilt by pressure reception.

In this connection, FIGS. 3 (*b*) to (*e*) described above have an advantage of being able to perform positioning of the ring member 3 at the same time by fitting the ring member 3 onto the column member 2. Therefore, even if pressure reception is repeatedly performed, the position of the ring member 3 does not change, and can be grasped at a fixed position. As a matter of course, in the shock absorbing structure 1 shown in FIG. 3 (*d*), even when the ring member 3 rises relatively to the column member 2 at the time of pressure reception, the ring member 3 drops by its own weight to return to the original position, and is returned to the initial position.

Figure 4:
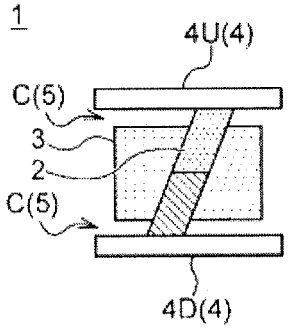
FIG. 4 shows sectional views of shock absorbing structures showing variations in which column members are configured by parts having a plurality of different materials or different properties.
Figure 4:
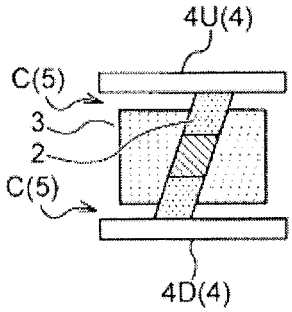
Figure 4:
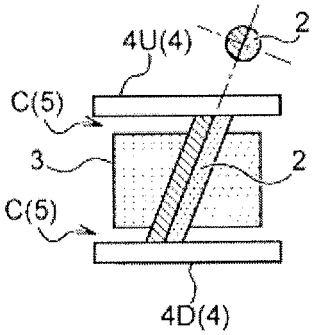
Figure 4:
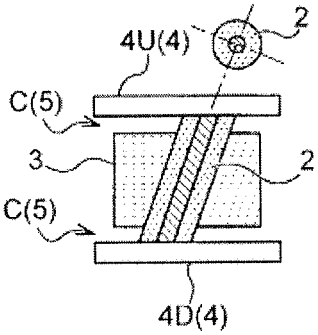
Figure 4:
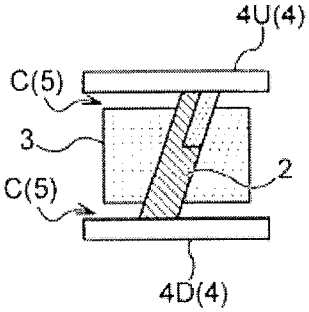

Further, in each of the embodiments described above, the column member 2 which is basically formed from one kind of material is illustrated, but the present invention is not necessarily limited to this. As shown in FIG. 4 (*a*), for example, the single column member 2 may be formed from materials with different properties in an upper portion and a lower portion of the column member 2, and may be configured so that a repulsive force and a way of tilting differ depending on the properties such as hardness. In this case, deformation (tilting and bulging) of the column member 2 at the time of pressure reception differs in the upper portion and the lower portion even in the same column member 2, the portion with lower hardness easily undergoes bulging deformation, and the bulging degree becomes larger, for example.

If the lower side of the column member 2 is formed from a material with high hardness, and the upper side is formed from a material with low hardness, for example, the upper side pressure receiving portion 4U easily tilts at the time of pressure reception (easily brought into a non-horizontal state), and action of guiding movement of a foot of a wearer, an action of guiding a shift direction of the center of gravity and the like can be expected.

Further, when the repulsive force and the way of tilting are caused to differ depending on the properties such as hardness in the same column member 2, the column member 2 may be formed into a multiple-stage shape with three stages or more. More specifically, as shown in FIG. 4 (*b*), for example, a structure may be adopted, in which an upper and lower portions in the single column member 2 are formed from a material with the same property (low hardness, for example), and a middle portion is formed from a material with a different property (high hardness, for example).

Further, an embodiment shown in FIG. 4 (*c*) is a mode in which in the single column member 2, properties such as hardness are made to differ in a left and a right of the column member 2, and shows an example in which the column member 2 in an oblique circular column shape is equally divided into the left and the right, and the respective parts are formed from different materials.

Further, an embodiment shown in FIG. 4 (*d*) is an example in which an inner circumferential portion and an outer circumferential portion of the column member 2 are formed from materials with different properties such as hardness. Here, the inner circumferential portion is formed into a thin oblique circular column shape, and the outer circumferential portion is formed into a cylinder shape (an oblique cylindrical shape) that covers the inner circumferential portion.

Further, FIG. 4 (*e*) is an example in which only a part of an upper side of the column member 2 is formed from a material with different properties such as hardness, and is a mode in which Figures (a) and (c) described above are combined as a technical idea (concept).

Figure 5:
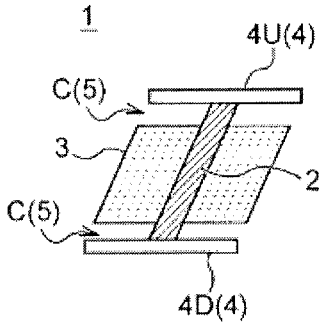
FIG. 5 shows sectional views showing various external shape variations of the ring member.
Figure 5:
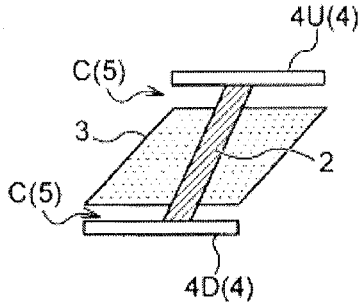
Figure 5:
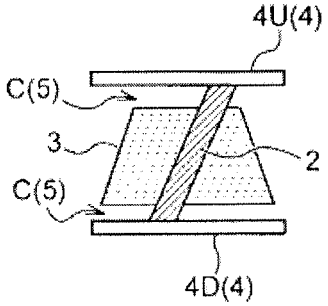
Figure 5:
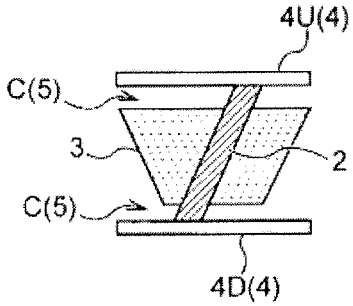
Figure 5:
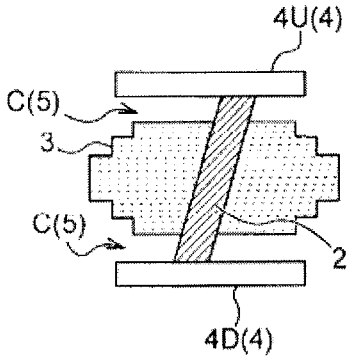
Figure 5:
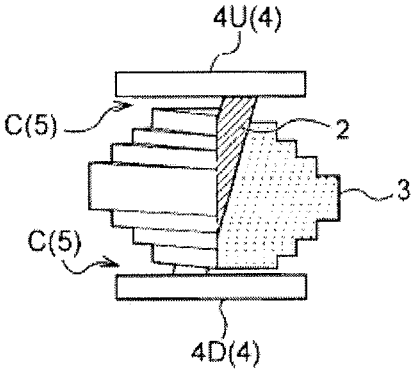

Further, in each of the aforementioned basic embodiments, as the external shape of the ring member 3, the external shape in a substantially column shape is mainly illustrated, but as the ring member 3, the external shape may be a solid body in an inclined shape (an oblique circular column shape substantially the same as the column member 2), as shown in FIG. 5 (*a*), for example. In this case, a section in side view of the ring member 3 is in a parallelogram. Here, the column member 2 is illustrated so as to penetrate through a substantially center of the ring member 3 (oblique circular column), but the position (penetration position) of the column member 2 may be configured to be eccentric to the ring member 3.

Further, as shown in FIG. 5 (*b*), for example, the ring member 3 may be in a mode in which an inclination of the external shape (inclination of the side face) is made to differ from the inclination angle of the column member 2. Here, in FIG. 5 (*b*), extra thicknesses of an upper right portion and a lower left portion of the ring member 3 are formed to be attached greatly, and this is because the relevant parts are the parts that undergo bulging deformation to a relatively large extent by tilting of the column member 2 as described above. That is, by the configuration like this, bulging of the ring member 3 is emphasized from the first deformation stage.

Further, although in each of the embodiment described above, the external shape of the ring member 3 basically has the same sectional size and sectional shape in the height direction, the present invention is not necessarily limited to this. More specifically, as shown in FIG. 5 (*c*), for example, a mode may be adopted, in which the external shape of the ring member 3 is formed into a solid shape (for example, a truncated cone) that is narrowed toward an upper side, or as shown in FIG. 5 (*d*), a mode may be adopted, in which the external shape of the ring member 3 is formed into a solid shape (a truncated cone which is formed by inverting a top and a bottom of FIG. 5 (*c*), for example) that is narrowed toward a lower side. The modes as above are modes in which the sectional sizes of the external shapes of the ring members 3 are changed smoothly in the height direction. Consequently, the restriction force and the holding force for the column member 2 by the ring member 3 differ in the height direction, and a shock absorbing characteristic different from the shock absorbing characteristic in the case where the external shape of the ring member 3 is formed into a circular column shape or an oblique circular column shape, that is, in the case where the sectional size of the external shape of the ring member 3 is not varied in the height direction is obtained.

Further, when the sectional size and the sectional shape of the ring member 3 are varied in the height direction, the sectional size and the sectional shape of the ring member 3 are not necessarily varied smoothly, but the sectional size (the diameter dimension) of the external shape of the ring member 3 may be varied stepwise in the height direction, as shown in FIGS. 5 (*e*) and (*f*), for example, whereby more various shock absorbing characteristics can be realized.

An embodiment shown in FIG. 5 (*f*) is an embodiment in which a sectional size (a diameter dimension) of an external shape of the ring member 3 is varied stepwise in the height direction, and the external shape of the ring member 3 is formed into a spiral shape. In this case, the ring member 3 also causes shearing deformation by a twist action, as the ring member 3 undergoes compression deformation in the vertical direction, so that a higher shock absorbing effect is exhibited.

Further, the ring member 3 may adopt a structure in which respective portions are formed from materials with different properties, and hardness and the like of the respective portions may be made to differ, similarly to the column member 2. That is, an embodiment shown in FIG. 6 (*a*) has a mode in which in an upper portion and a lower portion of a single ring member 3, a shock absorbing characteristic and a repulsion characteristic are made to differ in accordance with properties such as hardness. In this case, the restriction force and the holding force for the column member 2 by the ring member 3, the bulging deformation of the ring member 3 and the like differ between the upper portion and the lower portion. Further, at a time of shock absorption, the shock absorbing action in the second deformation stage can be generated in more multiple stages. That is, a part that is formed by a material with low hardness is mainly compressed in an early stage in the second deformation stage to absorb impact, and subsequently a part formed from a material with high hardness is mainly compressed later to absorb impact. In this connection, in shock absorption having a time difference like this, the compression in the material with low hardness is felt by a user as absorption of impact at a very fast speed, the compression in the material with high hardness is felt as absorption of impact at a low speed, and various impacts are efficiently absorbed.

Figure 6:
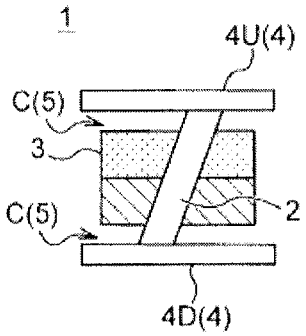
FIG. 6 shows sectional views variously showing variations in which ring members are configured by parts having a plurality of different materials or different properties.
Figure 6:
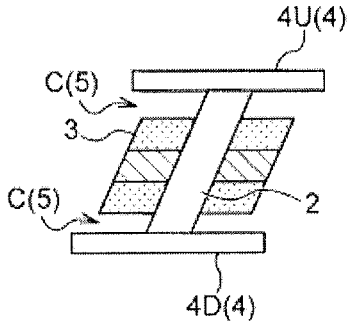
Figure 6:
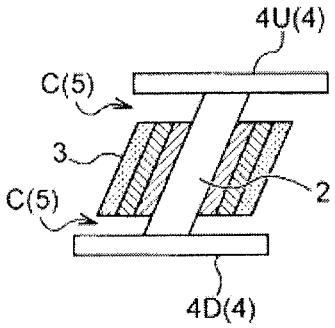
Figure 6:
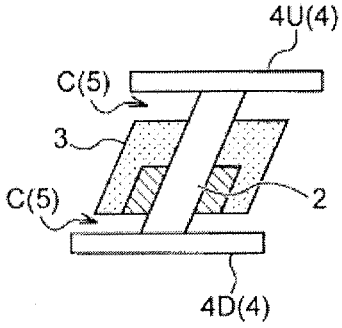
Figure 6:
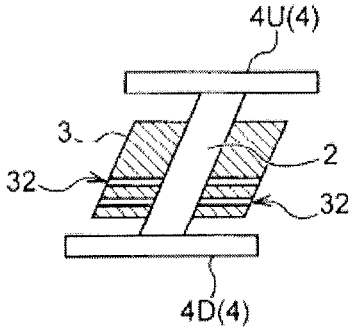

Further, when properties of respective portions are caused to differ in the same ring member 3, the ring member 3 may be structured to be formed into a multiple-stage shape with three stages or more, and as shown in FIG. 6 (*b*), for example, upper and lower portions of the single ring member 3 are formed from a material with the same property (for example, low hardness), and a middle portion is formed from a material of a different property (high hardness, for example). Here, a peculiar shock absorbing characteristic and repulsion characteristic can be obtained by bulging and restoration deformation modes corresponding to the structure.

Further, an embodiment shown in FIG. 6 (*c*) is an example in which in the single ring member 3, parts where a shock absorbing characteristic and a repulsion characteristic are caused to differ by a property such as hardness are formed into concentric oblique circular column shapes, and here, the concentric circular portions in three layers are formed from different materials. As a matter of course, in the ring member 3, properties can be caused to differ in one component, but a configuration may be adopted, in which the ring members 3 formed from materials with different properties may be provided by being fitted in multiple layers (three layers here).

Further, an embodiment shown in FIG. 6 (*d*) is an example in which in the single ring member 3, a lower side inner circumferential portion is formed from a material with different properties from materials of other parts, and is a mode in which Figures (a) and (c) described above are combined as a technical idea (concept).

Although even in the same ring member 3, the shock absorbing characteristic and the repulsion characteristic can be caused to differ in accordance with hardness or the like in respective portions if the respective portions are formed from materials with different properties or the like as described above, even when the single ring member 3 is formed from the same material, the shock absorbing characteristic and the repulsion characteristic can be caused to differ by causing the properties such as hardness are caused to differ partially. More specifically, as shown in FIG. 6 (*e*), for example, if many small holes 32 are opened in only a lower portion of the ring member 3 formed from the same material, the properties can be caused to differ partially even in the same ring member 3. This is, of course, the way of thinking which can be also applied to the column member 2.

Figure 7:
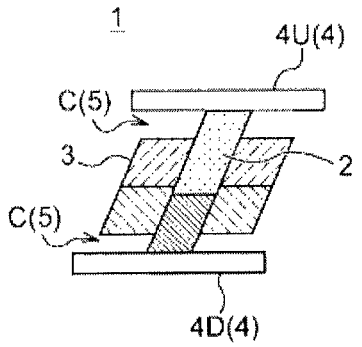
FIG. 7 shows sectional views showing two kinds of shock absorbing structures in which the column members and the ring members are configured by parts having a plurality of different materials or different properties.
Figure 7:
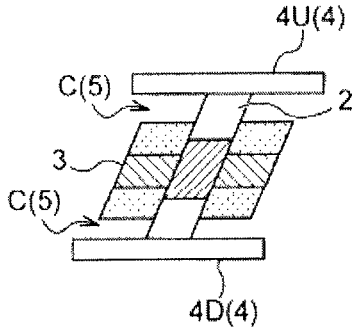

The column member 2 and the ring member 3 may be both configured from a plurality of different materials, or by parts having different properties described above as a matter of course, and FIG. 7 (*a*), for example, shows an embodiment in which a property such as hardness is caused to differ in upper and lower portions of the column member 2 and the ring member 3. Further, FIG. 7 (*b*) shows an embodiment in which the column member 2 and the ring member 3 are formed in multiple-stage shapes each with three stages or more in a vertical direction (here, in both of them, properties such as hardness are caused to differ in three stages). A same kind of smudging that is applied to sectional views in FIG. 7 shows a material with the same properties (hardness or the like).

Figure 8:
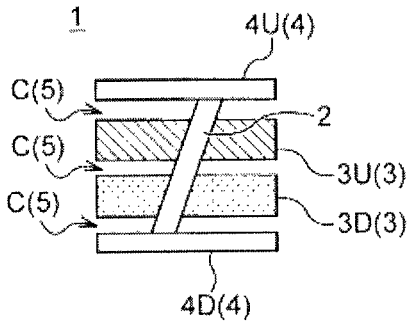
FIG. 8 shows sectional views showing two kinds of shock absorbing structures in each of which a plurality of ring members are provided by being fitted to a single column member.
Figure 8:
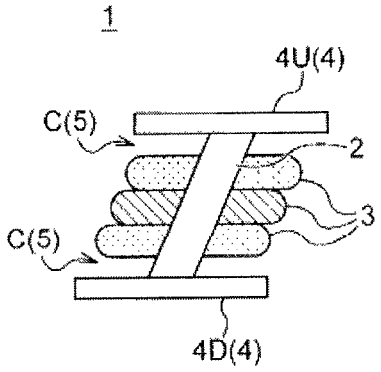

Further, although each of the aforementioned basic embodiments mainly illustrates the mode in which the single ring member 3 is provided by being fitted to the single column member 2, a mode can be adopted, in which a plurality of ring members 3 are provided by being fitted to the single column member 2, as shown in FIG. 8, for example.

Here, an embodiment shown in FIG. 8 (*a*) is a mode in which ring members 3 with different properties such as hardness are provided by being fitted to be in a row with spaces (clearances C) left in a vertical direction. In this connection, reference sign "3U" in FIG. 8 (*a*) denotes a ring member fitted to an upper side, and reference sign "3D" in FIG. 8 (*a*) denotes a ring member fitted to a lower side. Although in FIG. 8 (*a*), the clearances C are provided by being separated at three spots, as the way of providing the clearances C, various modes can be adopted.

Although specific illustration of a shock absorbing process in the shock absorbing structure 1 of the present embodiment is omitted, the first deformation stage is a stage in which the column member 2 tilts until the clearances C (sum total) seemingly disappear, and the ring members 3U and 3D respectively contact the upper and lower pressure receiving portions 4U and 4D and undergo shearing deformation. That is, from a time point when parts of the ring members 3U and 3D contact the pressure receiving portions 4U and 4D, shearing deformation from an inner circumferential side acts, and the ring members 3U and 3D are bulged to an outer circumferential side direction, by tilting of the column member 2. Depending on the disposition conditions of the clearances C, and the shapes and disposition conditions of the ring members 3U and 3D, deformation by partial contact of the ring member 3U and the ring member 3D is also added.

Further, the second deformation stage is a stage in which compression by the upper and lower pressure receiving portions 4U and 4D is added to the ring member 3, in addition to the shearing deformation in the first deformation stage, and at this time, the ring member 3 undergoes bulging deformation to a large extent in a part (for example, the upper side ring member 3U) where the ring member 3 which is soft in property is provided by being fitted. Accordingly, even when the ring members 3 with different properties are provided by being fitted in series like this, a unique shock absorbing characteristic is obtained.

Although explanation is made such that the properties of the respective ring members 3U and 3D differ from each other in this case, a configuration may be adopted, in which the ring members 3 with totally the same properties are provided by being fitted.

When a plurality of ring members 3 are provided by being fitted to the single column member 2, a configuration may be adopted, in which the plurality of ring members 3 are provided by being fitted in a close contact state, as shown in FIG. 8 (*b*), for example. In this connection, FIG. 8 (*b*) shows a type in which three ring members 3 are provided by being fitted in layers in a stair shape (a type presenting an oblique column shape as an entire shape of the shock absorbing structure 1).

Further, in each of the aforementioned basic embodiments, the ring member 3 in which the height dimension is basically constant throughout the entire circumference is illustrated, the height dimension of the ring member 3 does not have to be necessarily constant throughout the entire circumference, but may be configured to differ partially.

Figure 9:
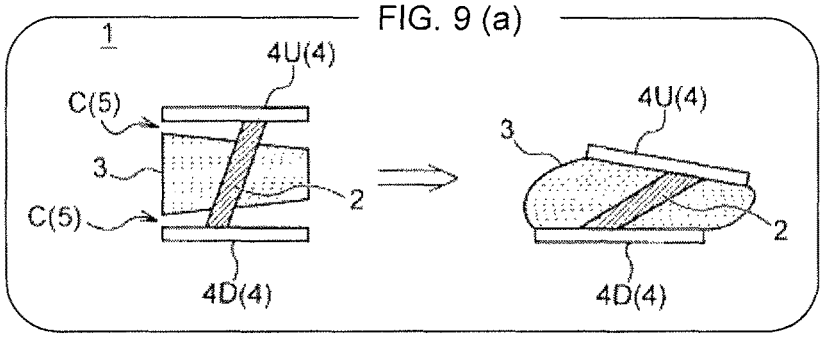
FIG. 9 shows explanatory views showing various embodiments each guides movement of a foot of a wearer by following a shock absorbing operation at a time of pressure reception, mainly by an external shape of a ring member.
Figure 9:
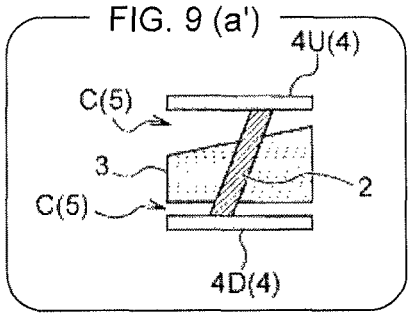
Figure 9:
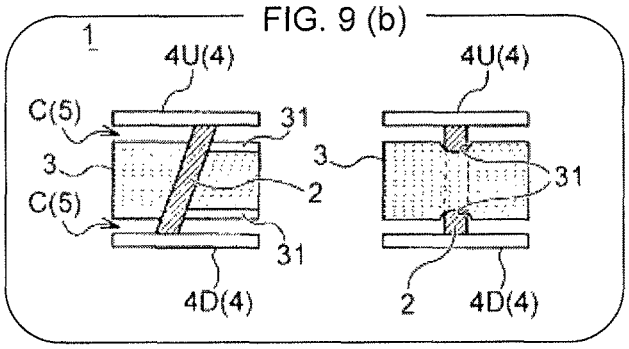
Figure 9:
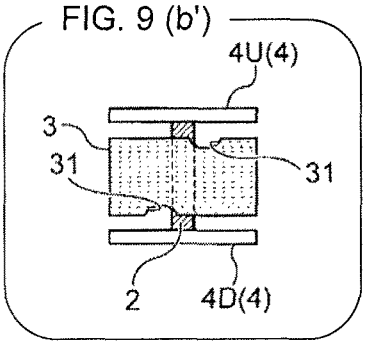
Figure 9:
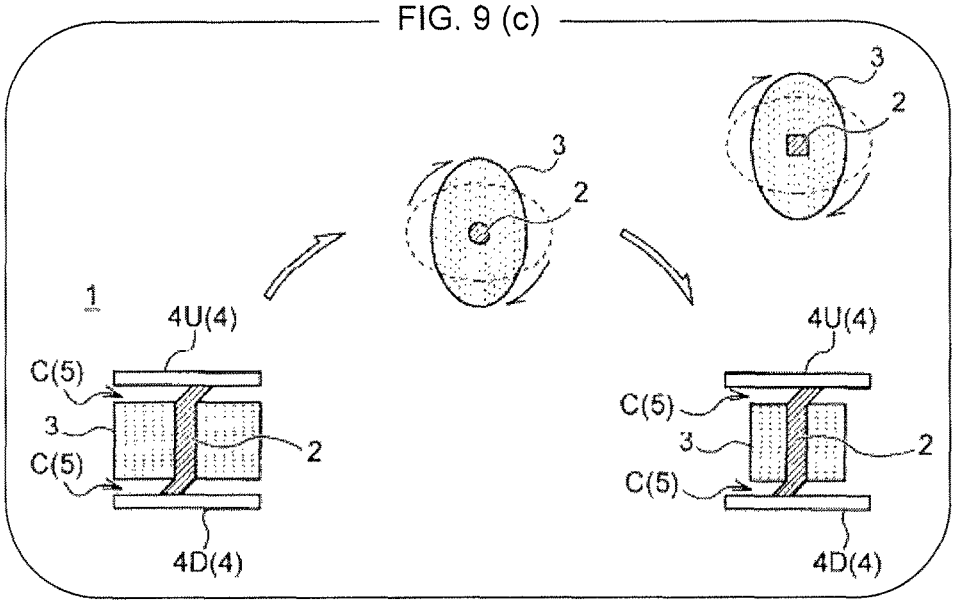

More specifically, as shown in FIG. 9 (*a*), for example, a mode may be adopted, in which an upper end edge and a lower end edge of the ring member 3 are inclined, and the ring member 3 is formed into a taper shape in a side view state. Here, FIG. 9 (*a*) shows a side of the ring member 3 with a smaller height dimension (a shorter side as a length dimension) is set as a right side, and a side with a larger height dimension (a longer side as the length dimension) is set as a left side.

A first deformation stage in the present embodiment is a stage in which the column member 2 tilts until the clearances C (sum total) disappear seemingly after the upper and lower pressure receiving portions 4U and 4D contact the ring member 3, and from a time point when a part of the ring member 3 contacts the pressure receiving portion 4, the ring member 3 receives shearing deformation from the inner circumferential side to be pressed to the outer circumferential side direction, and undergoes bulging deformation to the outer circumferential side direction.

Further, a second deformation stage is a stroke in which in addition to the tilting of the above described column member 2, direct compression by the upper and lower pressure receiving portions 4U and 4D is applied to the ring member 3, and bulging deformation by the compression is applied to the ring member 3.

In the second deformation stage, the upper and lower pressure receiving portions 4 are not parallel with each other, and fall down to the side with smaller height dimension as illustrated, because the ring member 3 is originally in a taper shape in side view, and the side with a larger height dimension is more difficult to undergo compression deformation than the side with a smaller height dimension.

The shock absorbing structure 1 as above (the shock absorbing structure 1 which falls down while exhibiting a shock absorbing action at the time of pressure reception) is provided in the shoe S, whereby a falling direction of a foot of a wearer can be controlled while impact which is applied on the foot (the shoe S) is absorbed, in a period from a landing motion to a kicking-out motion of the foot, for example. That is, a human foot is ordinarily equipped with a function that is called "pronation" that alleviates impact by an ankle falling inward when the human foot receives impact at a time of landing on the ground. However, if falling becomes excessively large due to physical constitution, fatigue or the like, falling becomes "over pronation", which causes excessive inward roll of a knee, and is said to be the cause of "Runner's Knee" which is a running impediment. In such a case, by providing the shock absorbing structure 1 as described above (by disposing the side with a larger height dimension of the ring member 3 to face to an inner side (MEDIAL) of a foot, for example), pronation is made mild, and over pronation can be prevented.

As above, the shock absorbing structure 1 does not only absorb applied impact, but also can have an action to guide the impact to a specific direction.

An embodiment shown in FIG. 9 (a') is an embodiment in which while a lower end edge of the ring member 3 is formed into a substantially horizontal state, only an upper end edge is inclined, and the ring member 3 is formed to form an inclination shape in a side view state.

Although a specific shock absorbing mode is not illustrated in the present embodiment, either, a first deformation stage is a stage in which the column member 2 tilts until the clearances C (sum total) disappear seemingly, and from a time point when the pressure receiving portions 4U and 4D contact the ring member 3, the ring member 3 receives shearing deformation from an inner circumferential side to undergo bulging deformation to an outer circumferential side direction.

Further, a second deformation stage is a stroke in which in addition to the tilting of the column member 2 like this, direct compression by the upper and lower pressure receiving portions 4U and 4D is applied to the ring member 3, and bulging deformation by the compression is also applied to the ring member 3 compositely.

Consequently, in the second deformation stage, in the manner described above, the upper side pressure receiving portion 4U falls down to the side with a smaller height dimension, of the ring member 3, and over pronation which occurs to the foot of a wearer can be prevented, for example.

When the ring member 3 is formed into the inclination shape in side view, the inclination shape in side view can be realized by inclining only a lower end edge of the ring member 3, and a similar effect can be obtained.

Further, in order to cause the height dimension of the ring member 3 to differ partially instead of making the height dimension constant throughout the entire circumference, a mode is not limited to the mode of inclining the upper end edge and the lower end edge of the ring member 3, but a mode may be adopted, in which parts of the upper end edge and the lower end edge of the ring member 3 are cut out (the parts are referred to as cutouts 31), for example, and the height dimension of the ring member 3 is partially decreased, as shown in FIG. 9 (*b*). In FIG. 9 (*b*), the cutouts 31 at both the upper and lower end edges are formed to be located in a straight line in the substantially vertical direction, and in this case, in the second deformation stage, the upper side pressure receiving portion 4U falls down to a part with a smaller height dimension (a part where the cutout 31 is formed).

Note that the upper and lower cutouts 31 which are formed in the ring member 3 may be in a mode in which the upper and lower cutouts 31 are shifted to a certain degree in a circumferential direction as shown in FIG. 9 (b'), for example, and in this case, a twisting action can be also applied to the upper and lower pressure receiving portions 4U and 4D simultaneously with the falling motion of the pressure receiving portions 4. That is, the shock absorbing structure 1 in this case can guide a foot in such a manner as to twist the foot while tilting the foot in a specific direction, when absorbing impact.

An embodiment shown in FIG. 9 (*c*) shows the shock absorbing structure 1 in which a central portion of the column member 2, that is, a part to which the ring member 3 is fitted is formed in a straight shape, and an external shape (external appearance) of the ring member 3 is formed into an elliptic column shape (long circular column shape). In this case, as is also shown in FIG. 9 (*c*), if the height dimension of the ring member 3 is constant throughout the entire circumference, and the ring member 3 is not bonded and fixed to the column member 2, a user himself or herself can change (adjust) tilting easiness of the column member 2 at the time of pressure reception by freely rotating the ring member 3, for example. That is, since the column member 2 tilts in the inclination forming direction with pressure reception, a wall thickness dimension in the radial direction of the ring member 3 in the inclination forming direction is changed by rotating the ring member 3, and tilting easiness of the column member 2 can be changed (adjusted). When the wall thickness dimension in the radial direction of the ring member 3 is set to be minimum in the inclination forming direction, the column member 2 tilts most easily, as a matter of course.

In this connection, FIG. 9 (*c*) shows a situation in which the ring member 3 is rotated approximately 90 degrees from a state where the wall thickness dimension (in the radial direction) of the ring member 3 is initially set as maximum in the inclination forming direction, and the column member 2 is made easy to tilt in the inclination forming direction. In the present embodiment, the column member 2 is formed into a shape polygonal in section, whereby a position of the ring member 3 after rotation is configured to be easily fixed, as also shown in FIG. 9 (*c*), for example.

The idea like this gives a new added value to the shoe S in the point that the user himself or herself can obtain enjoyment of finding out a unique shock absorbing characteristic.

Figure 10:
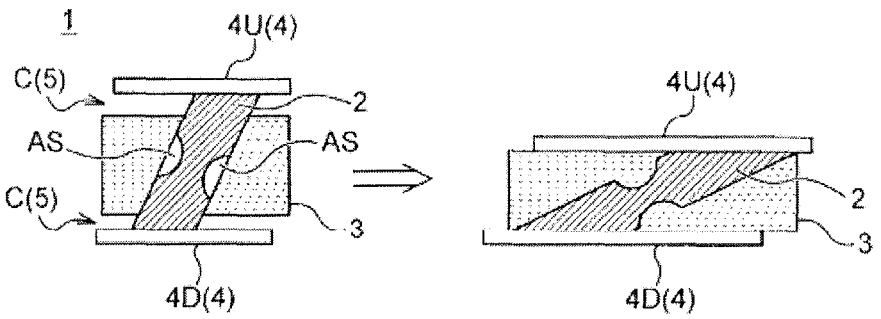
FIG. 10 shows an explanatory view showing a shock absorbing structure in which a ring deformation allowing space that allows bulging deformation of a ring member is formed in a column member (a), and an explanatory view showing a shock absorbing structure in which the ring deformation allowing space is formed in a ring member (b).
Figure 10:
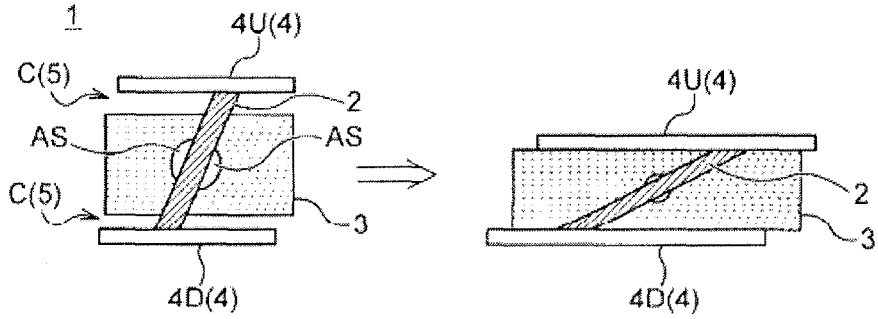

As shown in FIG. 10 (*a*), for example, in the column member 2, a ring deformation allowing space AS in a depressed concave shape may be formed in a contact site to the ring member 3. As is also shown in FIG. 10 (*a*), the ring deformation allowing space AS functions as a deformation allowing space at a time when the ring member 3 causes bulging deformation at the time of pressure reception, and thereby makes the ring member 3 cause bulging deformation easily and can enhance the shock absorbing characteristic as the shock absorbing structure 1.

Although FIG. 10 (*a*) shows that an inner circumferential face of the bulged ring member 3 (at a side of the ring deformation allowing space AS) enters a deep portion in the ring deformation allowing space AS, such a deformation behavior is not always taken, and depending on the hardness and the like of the ring member 3 and the column member 2, the inner circumferential face of the ring member 3 does not enter the deep portion of the ring deformation allowing space AS. However, by forming the ring deformation allowing space AS like this, at least the ring member 3 becomes easily deformable at the time of pressure reception.

The ring deformation allowing space AS is not necessarily formed in the column member 2, but may be formed in the ring member 3 itself as shown in FIG. 10 (*b*), for example. In this case, the ring deformation allowing space AS also functions as a deformation allowing space for the ring member 3 at the time of pressure reception, and enhances a shock absorbing characteristic as the shock absorbing structure 1. However, in this case, the ring deformation allowing space AS formed in the ring member 3 gradually reduces seemingly, with advance in pressure reception.

The mode in which the ring deformation allowing space AS is provided in the column member 2 or the ring member 3 is also a mode in which a cavity is formed in mutual contact portions to reduce contact areas of both of them, and therefore, the restriction force and the holding force for the column member 2 by the ring member 3 can be reduced to some degrees. Deformation (tilting and bulging) of the column member 2 at the time of pressure reception easily occurs correspondingly to the reduction.

Figure 11:
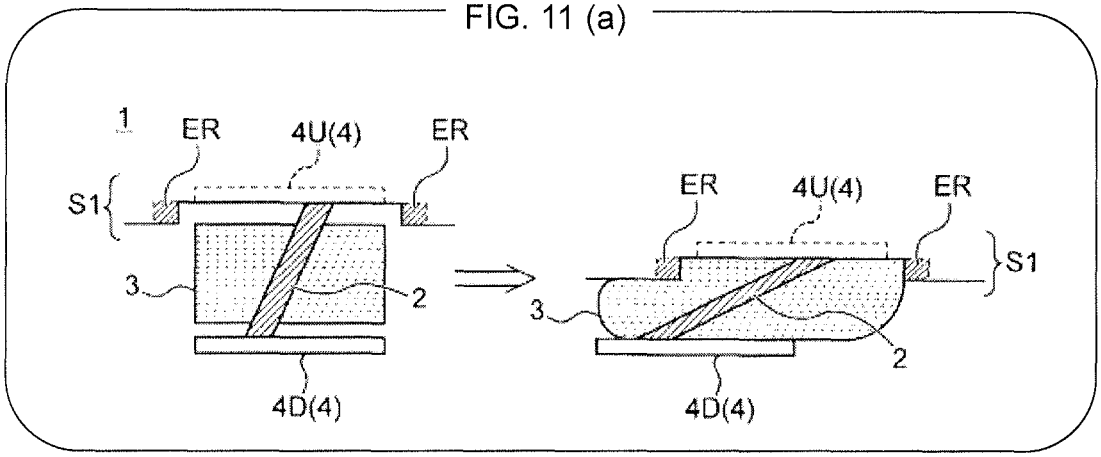
FIG. 11 is an explanatory view showing various embodiments in which bulging restriction portions that restrict bulging deformation of ring members are formed outside the ring members.
Figure 11:
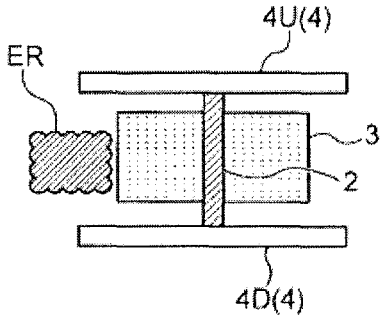
Figure 11:
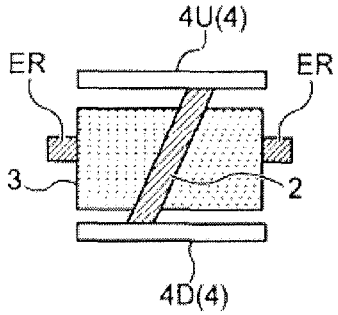

As shown in FIG. 11, for example, a configuration may be adopted, in which a bulging restriction portion ER that restricts bulging deformation of the ring member 3 is provided outside (an outer circumferential side) of the ring member 3.

Here, in FIG. 11 (*a*), the bulging restriction portion ER is formed into a ring shape (an annular shape) in an upper portion of the shock absorbing structure 1, and the upper side pressure receiving portion 4U is formed integrally with the sole S1. Further, shaded portions in FIG. 11 (*a*) correspond to the bulging restriction portion ER, and this is also formed integrally with the sole S1, or provided to be in an embedded state in the sole S1. In this case, as is also shown in FIG. 11 (*a*), especially in a second deformation stage, in the ring member 3, the upper portion side adheres closely to the bulging restriction portion ER, and correspondingly to this, the bulging restriction portion ER bulges greatly at a lower portion side where no bulging restriction portion ER is present.

FIG. 11 (*b*) shows a mode in which the bulging restriction portion ER is partially formed outside the shock absorbing structure 1 (a so-called a wall-surface shape). In this case, especially in the second deformation stage, the ring member 3 bulges significantly to a side where no bulging restriction portion ER is present. That is, as the bulging deformation is restricted by the bulging restriction portion ER, the ring member 3 can be guided to undergo bulging deformation significantly to the side where no bulging restriction portion ER is present.

Further, FIG. 11 (*c*) shows a mode in which the bulging restriction portion ER is directly provided by being fitted onto an outer side (an outer circumferential side) of the ring member 3, which is assumed to be a mode in which a hard metal ring is applied as the bulging restriction portion ER, for example. In this case, a deformation situation of the ring member 3, that is, shock absorbing performance of the shock absorbing structure 1 differs depending on a position where the bulging restriction portion ER is fitted. Alternatively, if the bulging restriction portion ER is formed from a material with elasticity like a rubber ring, restoration to the initial state from the state where the ring member 3 is bulged, for example, can be promoted.

In this way, the material, the shape, the installation spot, the number of the bulging restriction portions ER to be installed, and the like of the bulging restriction portions ER can be properly set in accordance with how deformation of the ring member 3 is restricted at the time of pressure reception (in accordance with intended control). Conversely speaking, the shock absorbing performance of the shock absorbing structure 1 can be controlled by controlling the ways of deformation of the column member 2 and the ring member 3 at the time of pressure reception.

Next, the action wait portion 5 other than the clearance C will be described.

Figure 12:
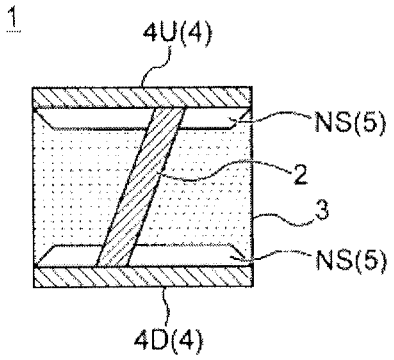
FIG. 12 shows explanatory views of shock absorbing structures showing two kinds of action wait portions other than a clearance.
Figure 12:
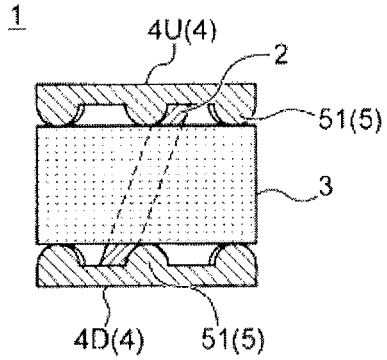

As the action wait portion 5 other than the clearance C, as shown in FIG. 12 (*a*), for example, a mode can be cited, in which contact tip end portions to the pressure receiving portions 4 in the ring member 3 are formed into acute-angle shapes in an entire circumference, and an unfilled space NS where no thickness (material) of the ring member 3 is present is formed in that site (since the ring member 3 contacts the pressure receiving portions 4, the space is not present as the clearance C). In this case, if load is applied, not only the column member 2 inside tilts, but also the ring member 3 outside receives compression by the upper and lower pressure receiving portions 4U and 4D substantially at the same time. However, compression of the ring member 3 in this stage becomes a deformation behavior of the thickness (material) of the ring member 3 which should originally perform bulging deformation moving to fill the above described unfilled space NS, and therefore, bulging deformation hardly occurs as external bulging deformation. Accordingly, a certain time difference occurs after start of pressure reception until the ring member 3 causes substantial bulging deformation, and therefore, the unfilled space NS like this also becomes one of the action wait portions 5. Further, with the time difference as above taken into consideration, a height at a time of the ring member 3 causing substantial bulging deformation (external bulging deformation) is referred to as "an effective working height" in the present description.

Further, as shown in FIG. 12 (*a*), when the unfilled space NS as the action wait portion 5 is formed in the ring member 3, the effective working height where the ring member 3 performs substantial bulging deformation becomes a height dimension obtained by subtracting "the length dimension of the action wait portion 5 (until the unfilled space NS is filled, or until the ring member 3 causes external bulging deformation)" from "a maximum height (in the initial state where no load is applied)".

The action wait portion 5 as above may be provided not only in the ring member 3, but also in the pressure receiving portions 4 and the column member 2 as a matter of course. More specifically, as shown in FIG. 12 (*b*), for example, a plurality of protrusions 51 that partially contact the ring member 3 are provided on substantially entire circumferences of a lower end edge of the upper side pressure receiving portion 4U and an upper end edge of the lower side pressure receiving portion 4D, and the protrusions 51 may be adopted as the action wait portion 5. Since in this case, the ring member 3 partially contacts the upper and lower pressure receiving portions 4U and 4D in the initial state where no load is applied, a deformation behavior similar to the above description is shown, and the protrusions 51 of the upper and lower pressure receiving portions 4U and 4D form the unfilled space NS as the action wait portion 5.

Although in each of the embodiments described above, the single shock absorbing structure 1 includes the single column member 2, a plurality of column members 2 may be included in the single shock absorbing structure 1. In this case, tilting directions of the plurality of column members 2 may be the same direction, or individual thicknesses and tilting directions may be made to differ from one another. Further, a configuration may be adopted, in which tilting characteristics (tilting easiness, tilting ranges and the like) of the individual column members 2 may be made to differ from one another. More specifically, as shown in FIG. 13, for example, a plurality of column members 2 can be provided in the single shock absorbing structure 1, and this is a mode in which the column members 2 are formed into a so-called cage shape.

Figure 13:
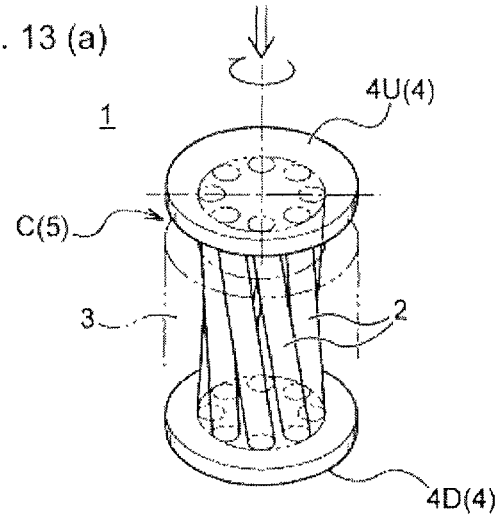
FIG. 13 shows explanatory views showing various embodiments in each of which a plurality of column members are provided in a single (one) shock absorbing structure, Figure (a) is a perspective view, and Figures (b) and (c) are skeletal plan views.
Figure 13:
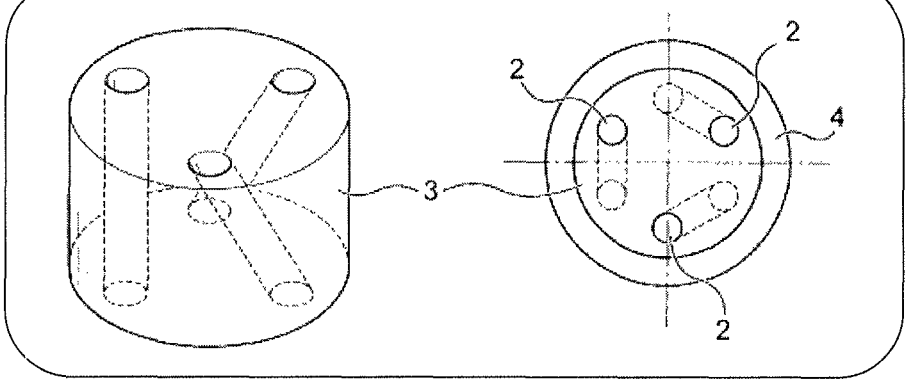

Here, for example, FIGS. 13 (*a*) and (*b*) show modes in which the single ring member 3 is fitted onto outer sides of a plurality of column members 2. However, as a mode of providing the ring member 3 by fitting, a mode may be adopted, in which the ring members 3 are fitted to the respective column members 2 one by one (the ring members 3 in the same number as the column members 2 are required), or a mode may be adopted, in which as shown in FIG. 13 (*c*), a plurality of column members 2 are divided into several groups, and the ring member 3 is provided by being fitted to each of the groups (the number of ring members 3 is smaller than the number of column members 2).

Further, in the present embodiment in which a plurality of column members 2 are vertically provided, as is also shown in FIG. 13 (*a*), if a plurality of column members 2 are provided equidistantly, and the tilting directions of the respective column members 2 are set to be in a tangential direction of the same circle, the pressure receiving portions 4 receive proper rotation (a twisting action is added) with tilting of the respective column members 2 (tilting in the circumferential direction) at the time of pressure reception. Accordingly, not only compression deformation in the vertical direction but also shearing deformation due to the column members 2 tilting while rotating is applied to the shock absorbing structure 1 like this, whereby the shock absorbing structure 1 exhibits more effective shock absorbing performance.

As described above, when a plurality of column members 2 are provided in the single shock absorbing structure 1, various shock absorbing performances and load guiding characteristics can be presented in accordance with a pattern of providing the ring member 3 by fitting. For example, if two column members 2 are arranged side by side, as a plurality of parts making up the single shock absorbing structure, the tilting and rising direction of the single shock absorbing structure at the time of pressure reception can be set to a combined direction of the respective tilting and rising directions of the column members 2, whereas when three or more column members 2 are arranged side by side, if the column members 2 are designed and disposed so that concentration of forces and breakage do not occur, a setting that guides the load shift to the combined direction also can be set.

Further, if hardnesses and the thicknesses (shapes) and the like of the respective column members 2 and the respective ring members 3 are caused to differ, more various shock absorbing characteristics can be generated. The plurality of column members 2 shown in FIG. 13 described above may be formed from a material of the same properties, or may be formed from materials of different kinds of properties.

In this connection, in the case where the ring members 3 are provided by being fitted to the individual column members 2 one by one, or the like, the shock absorbing structures 1 (the ring members 3) adjacent to one another can be caused to interfere with one another at the time of pressure reception, whereby more various shock absorbing characteristics can be obtained by the interference. As a matter of course, in the case like FIG. 13 (*c*) described above (the case where the ring member 3 is provided by being fitted to each of the column members 2 which are divided into groups), the ring members 3 can be also caused to interfere with one another at the time of pressure reception.

Further, when a plurality of column members 2 are provided in the single shock absorbing structure 1 as in FIG. 13 described above, the individual column members 2 are formed from a hard resin material, and the column members 2 can be caused to undergo bulging deformation positively to an outer circumferential side especially from the first deformation stage at the time of pressure reception.

Figure 14:
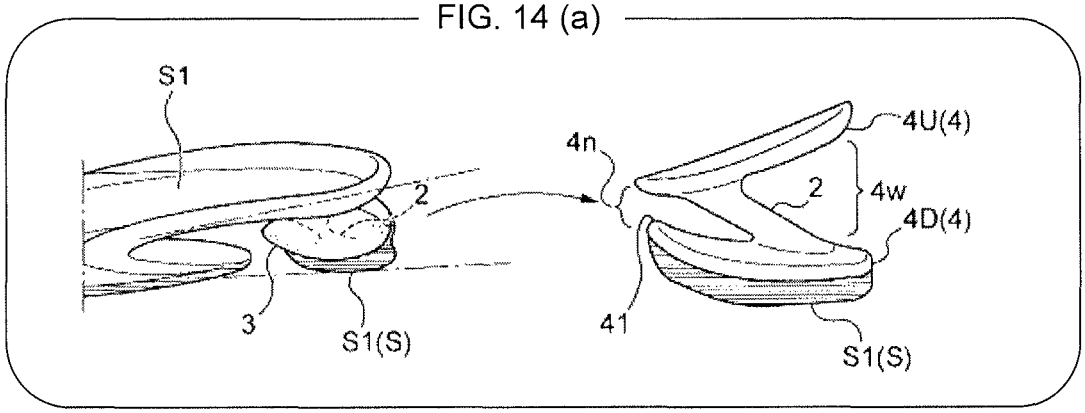
FIG. 14 shows explanatory views showing various embodiments each in a case where the upper and lower first and second pressure receiving portions facing each other are set to be unparallel to each other in an initial state.
Figure 14:
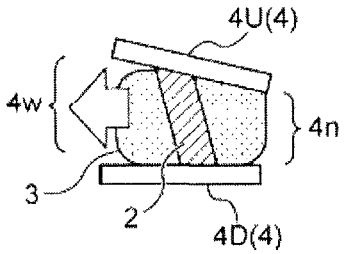
Figure 14:
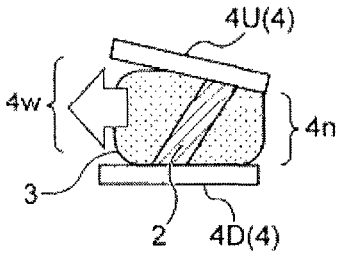
Figure 14:
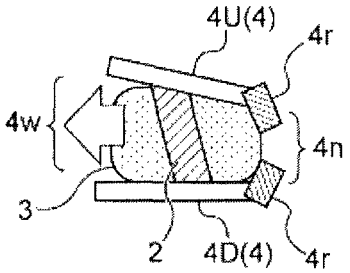
Figure 14:
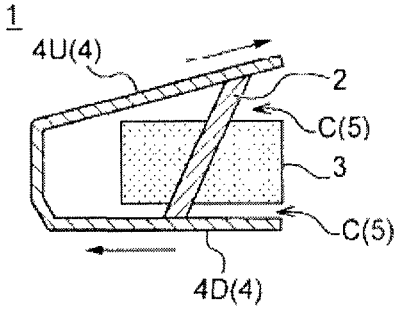

Although in the embodiment described above, the upper and lower pressure receiving portions 4U and 4D which face each other are set to be basically parallel (substantially horizontal) in the initial state, the present invention is not necessarily limited to this, and as shown in FIG. 14 (*a*), for example, the upper and lower pressure receiving portions 4U and 4D which face each other may be set to be unparallel with each other in the initial state.

Here, in FIG. 14 (*a*), the shock absorbing structure 1 provided in a heel portion of the shoe S is illustrated, and while the lower side pressure receiving portion 4D is set to be substantially horizontal, the upper side pressure receiving portion 4U is provided to be in an inclined state (so that the front side of the shoe inclines downward). By adopting such a configuration (the configuration in which the upper and lower pressure receiving portions 4U and 4D facing each other are provided unparallel with each other), a shock absorbing characteristic which corresponds to realities more can be obtained. That is, the shoe S at the time of landing or the like lands on the ground in an inclined state or bent state with a tiptoe side slightly facing upward more often than not, and the shoe S hardly falls down straightly while the entire shoe S keeps a horizontal state. Therefore, a more realistic shock absorbing characteristic is obtained by making the upper and lower pressure receiving portions 4U and 4D nonparallel with each other in accordance with the installation position of the shock absorbing structure 1, the habit of walking of the wearer, the way of application of load and the like.

Here, in the configuration in FIG. 14 (*a*) described above, a relative angle (an interior angle in an intersection of extension lines of the pressure receiving portions 4U and 4D) in the initial state of the upper and lower pressure receiving portions 4U and 4D facing each other is preferably in a range of 15 to 75 degrees, for example.

A more preferable range of the angle differs depending on the place where the shock absorbing structure 1 is disposed. For example, a front portion (portion from a treading portion to a tiptoe portion, for example) of a shoe sole has a relatively small thickness in the shoe sole, and therefore, the column member 3 is preferably made long so that the column member 3 can be inclined significantly. In order to make the inclination of the column member 3 large like this, the aforementioned angle is preferably set at 15 to 45 degrees, for example, so that the relative angle of the pressure receiving portions does not become too large.

Conversely, a rear portion of the shoe sole (a portion from a plantar arch portion to a heel portion, for example) is relatively thick in the shoe sole, and therefore, necessity to incline the column member 3 significantly is small. In this case, the length of the column member 3 may be relatively short, and the relative angle of the pressure receiving portions may be relatively large. A preferable range of the aforementioned angle in this case is 30 to 75 degrees, for example. Reduction in weight can be realized by making the column member 3 short.

As shown in FIG. 14 (*a*), when only the upper side pressure receiving portion 4U is inclined, a space between the pressure receiving portions 4 is not constant throughout an entire circumference, a space dimension becomes larger at an upward side of the upper side pressure receiving portion 4U (here, a shoe rear side), and this side is referred to as a wide angle opening side 4*w*. The space dimension becomes small at a downward side (here, a shoe front side) of the upper side pressure receiving portion 4U, and this side is referred to as a narrow angle opening side 4*n*.

In the case of FIG. 14 (*a*), a considerable load is applied to the shock absorbing structure 1 at the time of landing, and the ring member 3 is excessively pressed out to the shoe front side in the second deformation stage. Consequently, as is also shown in FIG. 14 (*a*), a return 41 is formed at the shoe front side in the lower side pressure receiving portion 4D, so that the ring member 3 receiving an impact load can be prevented from excessively protruding (being pushed out) from the lower side pressure receiving portion 4D.

Here, although the inclination forming direction of the column member 2 is not specially limited, the ring member 3 significantly bulges at the wide angle opening side 4*w* originally when the impact load acts on the shock absorbing structure 1 in the case of FIGS. 14 (*b*) and (*c*), for example, (because a volume of the ring member 3 sandwiched between the upper and lower pressure receiving portions 4U and 4D is larger than a volume at the narrow angle opening side 4*n*).

For the above reason, if bulging restriction portions 4*r* for the ring member 3 are provided at the upper and lower pressure receiving portions 4U and 4D at the narrow angle opening side 4*n*, as shown in FIG. 14 (*d*), for example, the ring member 3 can be caused to bulge more significantly at the wide angle opening side 4*w*. That is, the bulging restriction portion 4*r* can be said to emphasize bulging deformation of the ring member 3 at the wide angle opening side 4*w*. Further, by the bulging restriction portion 4*r* like this, bulging deformation of the ring member 3 is restricted at the narrow angle opening side 4*n*, and therefore, hardness of the ring member 3 at the site at the time of pressure reception increases. Further, the bulging restriction portion 4*r* also contributes to prevention of removal of the ring member 3.

Providing the bulging restriction portion 4*r* like this is a method that can be also adopted when the upper and lower pressure receiving portions 4U and 4D are set to be parallel with each other, and is effective when the ring member 3 is desired to be bulged (emphasized) significantly to the outer peripheral face side of the shoe S, for example.

Further, in the shock absorbing structure 1, as shown in FIG. 14 (*e*) as an example, it is possible to connect the upper and lower pressure receiving portions 4, and cause the upper and lower pressure receiving portions 4 to function as a so-called flat spring. In this case, if the column member 2 is made tiltable by preventing the connected pressure receiving portions 4 from arresting movement in the shearing direction at the top and bottom, elasticity of the upper and lower pressure receiving portions 4 that function as a flat spring is added, in addition to the shock absorbing action by the column member 2 and the ring member 3 (deformation) described above, and therefore, a more peculiar shock absorbing characteristic is exhibited.

In this connection, when the upper and lower pressure receiving portions 4 are connected like the flat spring as in the present embodiment, the pressure receiving portions 4 are preferably formed of a different member from the sole S1, for example, a totally different hard resin material, and a polyether block amide copolymer (for example, PEBAX (a registered trademark)) or the like is applicable to this case, as an example.

The reason why the present embodiment in which the upper and lower pressure receiving portions 4 are connected is included in FIG. 14 is that the upper side pressure receiving portion 4U in the initial state of the present embodiment is set to be in an inclined state (the upper and lower pressure receiving portions 4 are drawn to be unparallel), but the present structure itself that connects the upper and lower pressure receiving portions 4 can be also adopted in the case where the upper and lower pressure receiving portions 4 are parallel.

Figure 15:
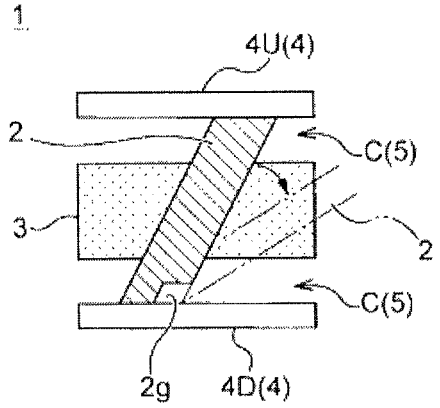
FIG. 15 shows sectional views showing three kinds of embodiments each in a case where a tilt guide portion is equipped in a column member.
Figure 15:
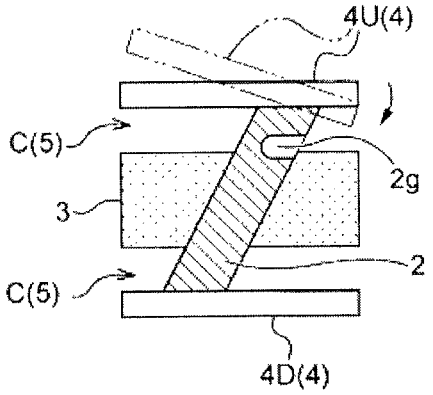
Figure 15:
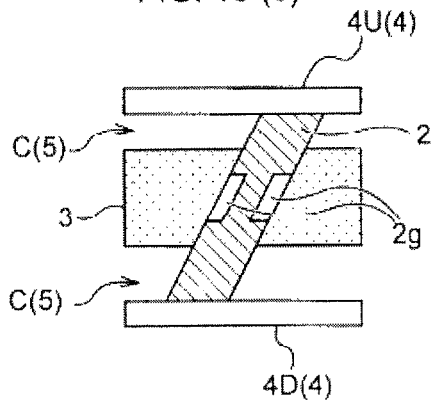

Further, the column member 2 can be provided with a structure that promotes tilting of itself following pressure reception (this will be referred to as a tilt guide portion 2*g*), and the structure is configured by cutting out a part of the column member 2, as shown in FIG. 15 (*a*), for example.

Here, in FIG. 15 (*a*) described above, a cutout that is formed in a vicinity of a root of the column member 2 is referred to as the tilt guide portion 2*g*, but the formation site for the tilt guide portion 2*g* is not specially limited. That is, the tilt guide portion 2*g* may be formed in a vicinity of an upper end of the column member 2, as shown in FIG. 15 (*b*), for example. In this case, the upper side pressure receiving portion 4U may tilt more easily rather than the column member 2 itself, the tilt guide portion 2*g* is used with such a case (the case where not only the column member 2 but also the pressure receiving portion 4 is made easy to tilt) included.

In this connection, the cutout 20 shown in FIG. 3 (*f*) described above also can correspond to a kind of the tilt guide portion 2*g*.

Further, the tilt guide portion 2*g* may be formed into a cutout shape from both sides of the column member 2, as shown in FIG. 15 (*c*), for example. In this case, if the ring member 3 is formed from a transparent material (a translucent material), and is made visible externally, the tilt guide portion 2*g* looks in a different state (enlarged, reduced, changed in color tone, and the like, for example) when the ring member 3 undergoes bulging deformation, so that the shock absorbing performance can be made appealing more strongly, and interest in design can be produced in addition.

In this connection, the above described tilt guide portion 2*g* which is formed in a contact site to the ring member 3 also can function as the ring deformation allowing space AS already described. Alternatively, a connection portion of the column member 2 and the pressure receiving portion 4 may be made a movable structure such as a ball joint although not illustrated.

Figure 16:
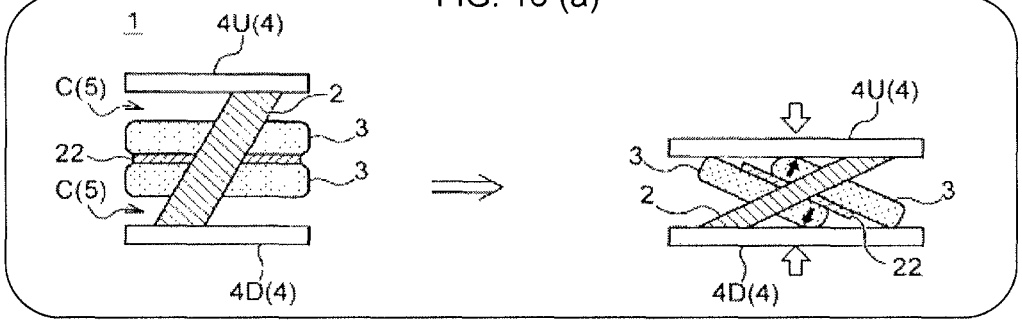
FIG. 16 shows explanatory views showing various embodiments in which flange bodies are formed in column members.
Figure 16:
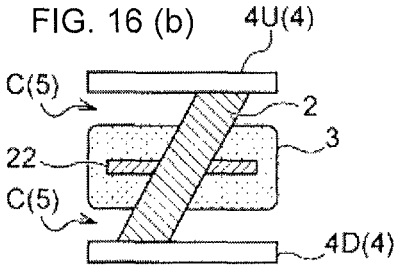
Figure 16:
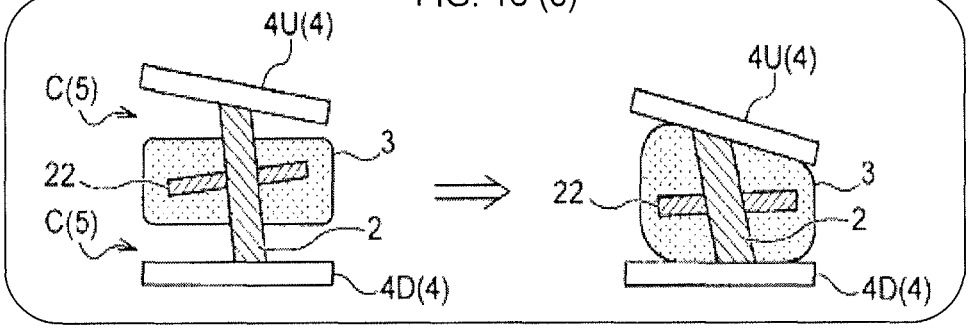
Figure 16:
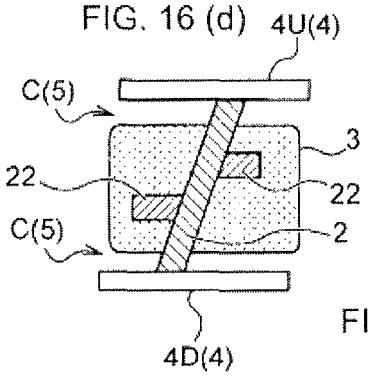
Figure 16:
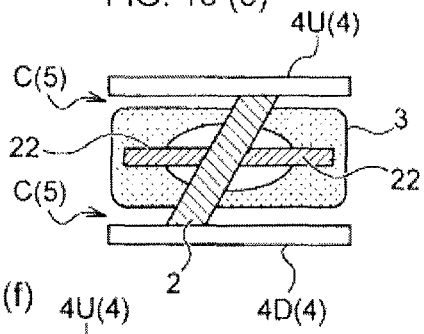
Figure 16:
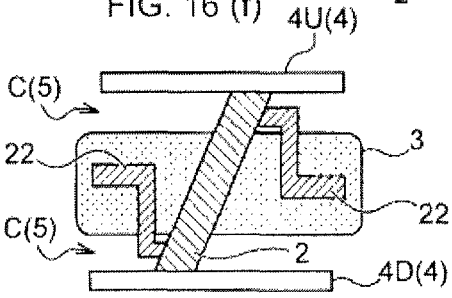

As shown in FIG. 16 (*a*) as an example, the column member 2 can be provided with a flange body 22 that extends to an outer circumferential side direction, and the flange body 22 is provided specially to guide deformation of the ring member 3 to the top and bottom faces from an interior. The flange body 22 may be formed in a continuous state in the circumferential direction (a so-called disk shape), or may be formed in a discontinuous state in the circumferential direction (for example, a rib in a fan shape, a thin plate shape, or the like).

By providing the flange body 22 as above in the column member 2, deformation (compression and bulging) of the ring member 3 at the time of pressure reception can be promoted. For example, when the column member 2 tilts by pressure reception as is also shown in FIG. 16 (*a*), in the flange body 22, forces that press the ring members 3 work by receiving an influence of the tilting of the column member 2, as shown by the arrows attached in the ring members 3 in FIG. 16 (*a*).

In this connection, the flange body 22 also has action of preventing slide of the column member 2 and the ring members 3 (column reception holes 3*h*) when the column member 2 tilts and converting tilting of the column member 2 into bulging deformation of the ring member 3 reliably, and therefore the flange body 22 also contributes to emphasizing bulging deformation of the ring member 3.

Although FIG. 16 (*a*) described above shows that separate ring members 3 are provided by being fitted to a top and a bottom of the flange body 22 which is formed in a middle stage of the column member 2, the installation mode of the flange body 22 is not necessarily limited to this, but a mode may be adopted, in which the flange body 22 is provided in the interior of the single ring member 3 as shown in FIG. 16 (*b*), for example.

The flange body 22 does not necessarily have to be installed horizontally (or parallel with the pressure receiving portions 4) in the initial state, but a mode may be adopted, in which the flange body 22 is provided in an inclined state (or in an unparallel state with the pressure receiving portions 4), as shown in FIG. 16 (*c*), for example. Here, in FIG. 16 (*c*), the upper side pressure receiving portion 4U in the initial state is set to be in an unparallel state with the lower side pressure receiving portion 4D, but the upper side pressure receiving portion 4U may be parallel with the lower side pressure receiving portion 4D.

When the flange body 22 is formed in a discontinuous state in the circumferential direction of the column member 2, a mode may be adopted, in which the left and right flange bodies 22 may be provided by changing positions in a height direction where the left and right flange bodies 22 are formed (a so-called staggered state) as shown in FIG. 16 (*d*), for example.

Further, as in FIG. 16 (*e*) and FIG. 16 (*f*), modes may be adopted, in which at least parts of the flange bodies 22 are embedded in the ring member 3.

Further, although in each of the embodiments described above, the column member 2 is basically formed of a single member (one member), and is not formed by combining a plurality of parts, the present invention is not necessarily limited to this, and in order to incorporate the ring member 3 into the column member 2 easily, for example, the column member 2 may be made by connecting a plurality of members (a composite structure).

Figure 17:
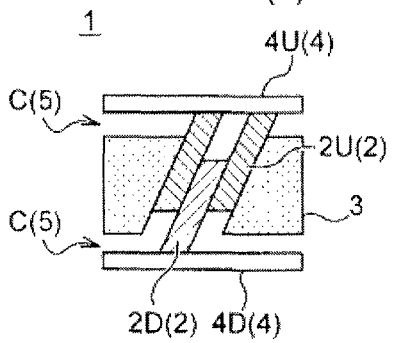
FIG. 17 shows explanatory views showing various embodiments in each of which a column member is formed by connecting a plurality of members, and in particular, Figures (d) and (e) are explanatory views each showing a state at a time of a ring member being removed (detached) from a column member (a shoe).
Figure 17:
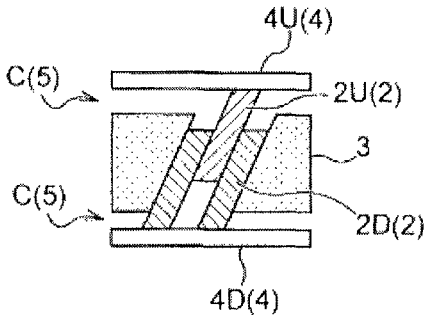
Figure 17:
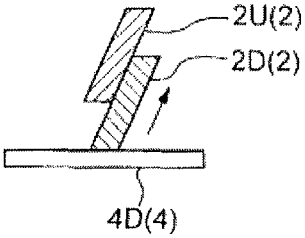
Figure 17:
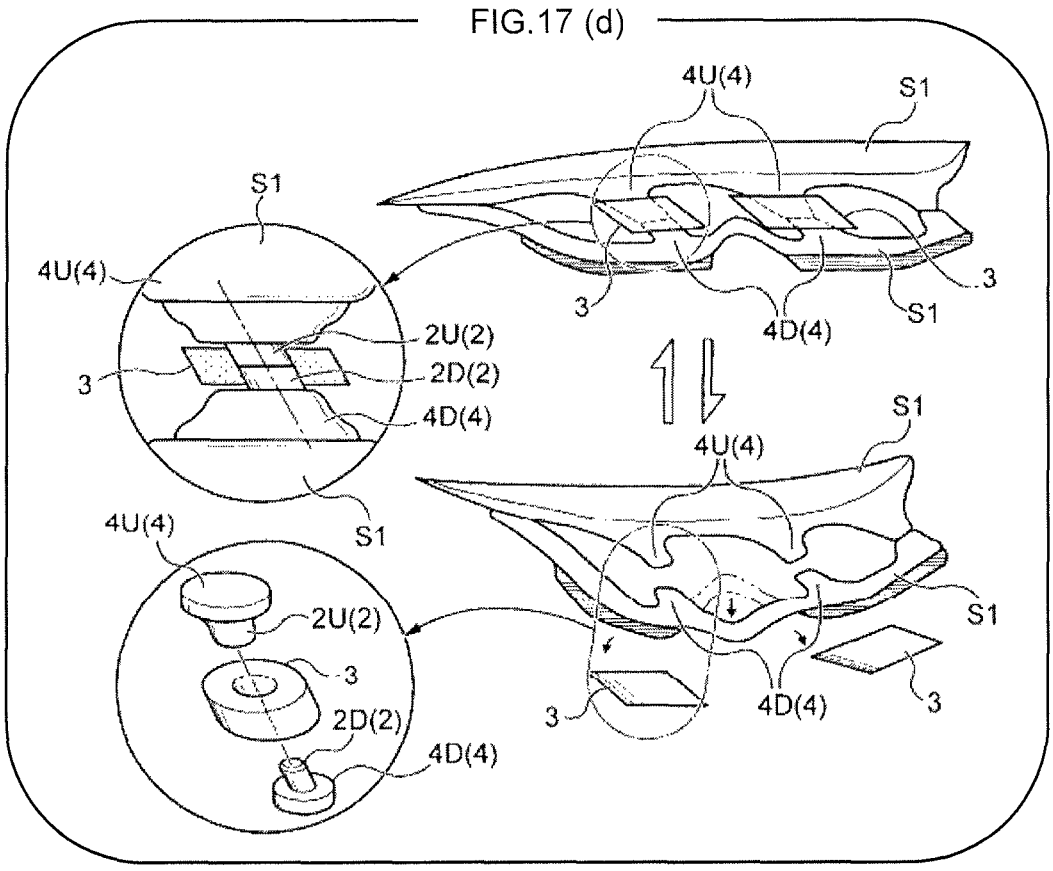

More specifically, as shown in FIG. 17 (*a*), for example, the column member 2 is vertically divided into two, and these two parts are formed into a nest state where the two parts are fitted to each other. Here, an upper portion of the column member 2 divided into two is referred to as an upper column member 2U, whereas a lower portion is referred to as a lower column member 2D, and in particular, the present embodiment adopts a fit in which the upper column member 2U is located outside and the lower column member 2D is located inside. Further, the upper column member 2U is configured to be always movable integrally with the upper side pressure receiving portion 4U, for example, by being formed integrally with the upper side pressure receiving portion 4U from the beginning (or formed as a separate member and bonded together), and the lower column member 2D is similarly configured to be movable integrally with the lower side pressure receiving portion 4D. Further, the ring member 3 is provided by being fitted to the column member 2 at an outer side (here, the upper column member 2U).

Further, in this case, air is sealed into a fitting space between the upper column member 2U and the lower column member 2D, and at the time of pressure reception, the upper and lower column members 2U and 2D approach each other while tilting, the air in the above described internal space is compressed to cause an air damper (air spring) action between the upper and lower column members 2U and 2D. Further, the lower column member 2D is set not to be disengaged (fallen off) from the upper column member 2U in the initial state where no load is applied.

Alternatively, the upper and lower column members 2D and 2U in FIGS. 17 (*a*) and (*b*) may be fitted by a threaded groove or a key groove though not illustrated.

In the case of FIG. 17 (*a*) described above, in the first deformation stage, the upper column member 2U and the lower column member 2D relatively approach (compressed as the shock absorbing structure 1) each other by a space amount of the clearance C while tilting, by received pressure load, and a damper action of the upper column member 2U and the lower column member 2D and bulging deformation of the ring member 3 by tilting of the column member 2 function as a shock absorbing action. Further, the first deformation stage is a stage until the clearance C becomes zero seemingly (until the upper and lower pressure receiving portions 4U and 4D contact the entire upper and lower faces of the ring member 3), and the ring member 3 does not directly receive compression by the upper and lower pressure receiving portions 4U and 4D.

In the second deformation stage, compression of the ring member 3 by the upper and lower pressure receiving portions 4U and 4D is added to deformation like this, and by the amount of addition of the compression, the shock absorbing structure 1 is more difficult to crush than in the first deformation stage (the shock absorbing characteristic is reduced, and the repulsion characteristic is enhanced).

In this connection, in the present embodiment, explanation is made such that air is sealed into the fitting space of the upper column member 2U and the lower column member 2D (a so-called air piston), but the substance to be sealed is not limited to air, as long as the substance is reduced in volume by compression, and a foamed material such as sponge may be used, for example. Further, a configuration in which air is absorbed and exhausted can be properly designed.

Further, an inside and outside relationship (fitting relationship) of the upper and lower column members 2U and 2D can be properly changed, and as shown in FIG. 17 (*b*), for example, a configuration may be adopted, in which the upper column member 2U is located inside, and the lower column member 2D is located outside.

Further, the upper column member 2U and the lower column member 2D do not necessarily have to be formed into a nest shape, and if the upper and lower column members 2U and 2D are not separated in the shearing direction (lateral direction) (if separation in the shearing direction can be restricted by the ring member 3 or the like, for example), the upper and lower column members 2U and 2D may be configured to be formed slidably in simply the vertical direction as shown in FIG. 17 (*c*), for example.

In this way, the column member 2 can be formed of a plurality of members in a nest shape or the like, that is, the ring member 3 can be also attached to and detached from the column member 2 (the shoe S) even after purchase, whereby the user can find out unique shock absorbing performance by replacing the ring member 3 for himself or herself, for example.

As shown in FIG. 17 (*d*), for example, the upper column member 2U and the lower column member 2D may be formed into a mere nest shape without a special fluid (substance) being filled into the fitting space of the upper column member 2U and the lower column member 2D.

Further, in FIG. 17 (*d*), the sole S1 is formed to be separable in an oblique vertical direction, and the ring member 3 is accommodated between upper and lower sides. Further, the upper side pressure receiving portion 4U and the upper column member 2U are integrally formed in the sole S1 at the upper side, and the lower side pressure receiving portion 4D and the lower column member 2D are integrally provided in the sole S1 at the lower side.

For example, in a case where the user replaces the ring member 3 for himself or herself or the like, the user accesses the sole S1 from a side portion of the shoe S, separates the sole S1 obliquely vertically, that is, separates the upper column member 2U and the lower column member 2D by the operation, and replaces (exchanges) the ring member 3, as shown in FIG. 17 (*e*).

Figure 18:
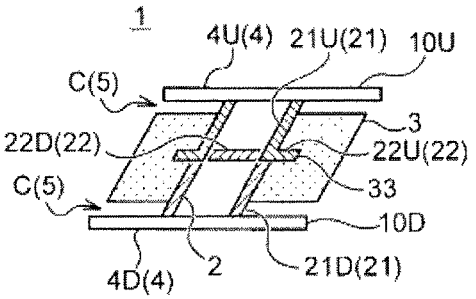
FIG. 18 Figure (a) is a sectional view showing an embodiment in which a column member is formed by combining a plurality of members (an upper column member and a lower column member), and flange bodies are provided in both of them, Figure (b) is an exploded perspective view with a ring member excluded, Figures (c) and (d) are sectional views each showing another modification example of a case in which a column member is formed by connecting a plurality of members, and Figure (e) is a perspective view at a time of a ring member being omitted from the shock absorbing structures in Figures (c) and (d).
Figure 18:
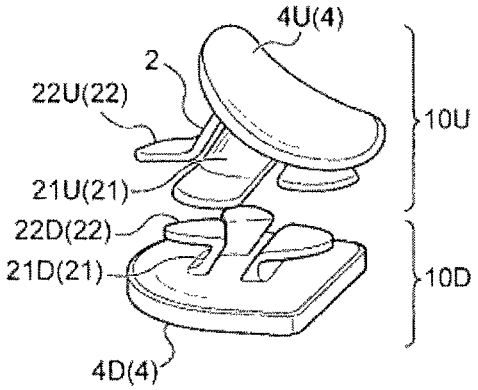
Figure 18:
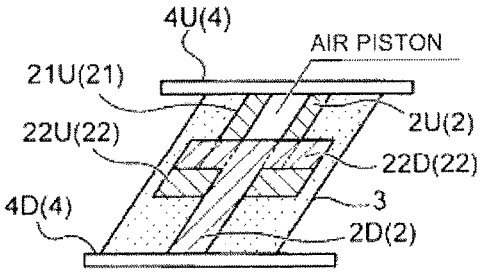
Figure 18:
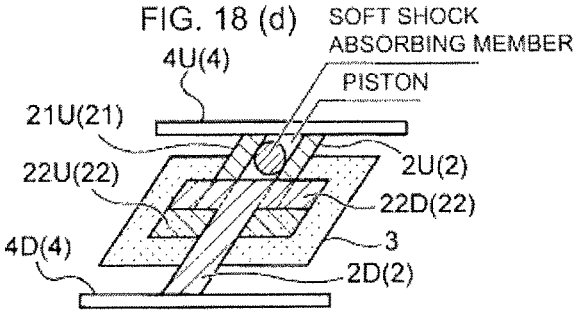
Figure 18:
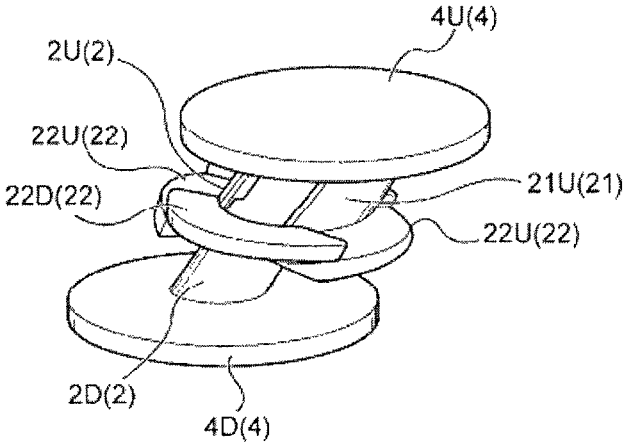

Further, when the column member 2 is formed of a plurality of members, flange bodies 22 may be configured to be provided side by side at the upper and lower column members 2, as shown in FIGS. 18 (*a*) and (*b*), for example. More specifically, as is also shown in FIGS. 18 (*a*) and (*b*), a column body 21 facing obliquely downward (forming a part of the column member 2, and specially referred to as an upper column body 21U) is formed on the upper side pressure receiving portion 4U first, the flange body 22 (specially referred to as an upper flange body 22U) is formed continuously to extend to an outer circumferential side from a lower end portion of the column body 21, and these upper side pressure receiving portion 4U, upper column body 21U and upper flange body 22U are generally called an upper part 10U.

Meanwhile, on the lower side pressure receiving portion 4D, a column body 21 facing obliquely upward (also forming a part of the column member 2, and specially referred to as a lower column body 21D) is also formed, the flange body 22 (specially referred to as a lower flange body 22D) is continuously formed to extend to the outer circumferential side from an upper end portion of the column body 21, and these lower side pressure receiving portion 4D, lower column body 21D and lower flange body 22D are generally called a lower part 10D.

The column bodies 21 and the flange bodies 22 of the upper and lower parts 10U and 10D are formed into a staggered shape in the respective upper and lower parts 10U and 10D. That is, as for the column bodies 21, the lower column bodies 21D are accommodated between the upper column bodies 21U (meshed with one another) in a state where the upper part 10U and the lower part 10D are fully compressed (in a closest state), and the upper and lower column bodies 21U and 21D present an external appearance of a three-dimensional cylinder shape. Meanwhile, as for the upper and lower flange bodies 22U and 22D, the lower flange bodies 22D are located between the upper flange bodies 22U, for example, in an initial state where no load is applied, and are configured to present a single disk shape in which the upper flange bodies and the lower flange bodies extend in an outer circumferential direction.

Consequently, when the separate upper and lower parts 10U and 10D are individually seen respectively, they are visually recognized as if the column bodies 21U and 21D and the flange bodies 22U and 22D formed continuous hook shapes on the upper and lower pressure receiving portions 4U and 4D, and have such an external appearance as to make it difficult to find out that these bodies form the three-dimensional column member 2 and flange body 22, as also shown in FIG. 18 (*b*).

Further, due to such a configuration, a groove 33 for receiving the flange body 22 is formed into a bored shape throughout an entire circumference in a central portion of an inner side of the ring member 3.

In the present embodiment, the ring member 3 is illustrated so as not to contact the upper and lower pressure receiving portions 4U and 4D in the initial state where no load is applied, and have the clearances C (refer to FIG. 18 (*a*)).

Here, in the case of the present embodiment, in the first deformation stage, the upper column body 21U (the upper part 10U) and the lower column body 21D (the lower part 10D) relatively approach by the space amount of the clearance C by the received pressure load while the upper column body 21U (the upper part 10U) and the lower column body 21D (the lower part 10D) are tilting.

Consequently, on the groove 33 which is formed in the ring member 3, forces (forces that spread out the ring member 3) that alternately work in axial direction (an axial direction of the column member 2) work, and the forces function as a shock absorbing action in the present first deformation stage. Bulging deformation from the interior by the upper and lower column bodies 21U and 21D tilting is also applied to the ring member 3 as a matter of course, and the bulging deformation also functions as the shock absorbing action.

Subsequently, in the second deformation stage, the upper and lower pressure receiving portions 4U and 4D directly compress the ring member 3, in addition to the aforementioned deformation, and bulging deformation by this is added to the ring member 3. Consequently, in the second deformation stage, the shock absorbing structure 1 inevitably becomes more difficult to crush than in the first deformation stage (the shock absorbing characteristic is reduced). When returning to the initial state, the upper and lower flange bodies 22U and 22D return to the original positions by the ring member 3, and function to return the ring member 3 to the original position.

Further, as an embodiment that deforms the entire shock absorbing structure 1 while tilting the column member 2 which is formed of a plurality of members, embodiments shown in FIGS. 18 (*c*) and (*d*) are cited. Here, the upper and lower flange bodies 22U and 22D shown in FIGS. 18 (*c*) and (*d*) are configured to be fitted to one another. Further, FIG. 18 (*c*) shows a mode having no clearance C, whereas FIG. 18 (*d*) shows a mode having the clearance C. Further, FIG. 18 (*d*) shows the mode in which a soft shock absorbing member of gel or the like is stored in the fitting space of the upper column member 2U and the lower column member 2D, instead of sealing air (instead of an air piston). FIG. 18 (*e*) is a perspective view with the ring member 3 in the shock absorbing structure 1 in each of FIGS. 18 (*c*) and (*d*) being omitted.

The shock absorbing structure 1 has the basic structure as above, and when the shock absorbing structure 1 like this is actually incorporated in the shoe S, or the like, the single shock absorbing structure 1 or a plurality of shock absorbing structures 1 which is or are suitable is or are disposed in a suitable position, in accordance with a running or walking condition. For example, an installation example shown in FIG. 19 (*a*) is a mode in which a plurality of shock absorbing structures 1 are not incorporated into an entire sole, but are incorporated into a thenar (a base of a big toe), a hypothenar (a base of a little toe), a heel portion (three spots near a heel, in this case). This is because a weight of a wearer is said to be evenly applied to three points (a triangle) of a thenar, a hypothenar, and a heal portion, and by only providing the shock absorbing structures 1 intensively in those sites, a balance at a time of walking can be kept stably (balance keeping theory of a triangle).

Figure 19:
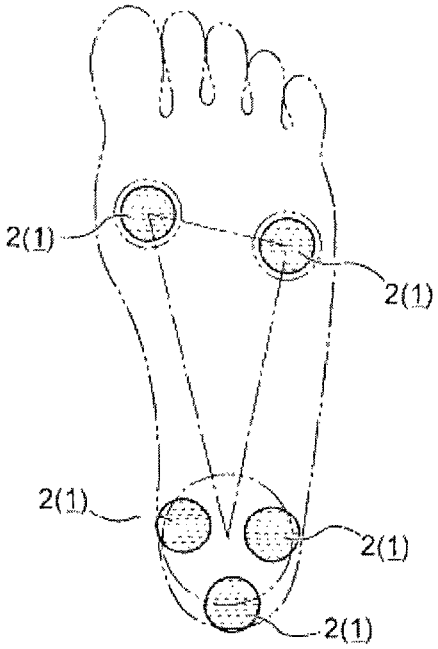
FIG. 19 shows disposition examples of a case where a plurality of shock absorbing structures are provided on a bottom face of a shoe (sole), Figure (a) is an explanatory view in which the shock absorbing structures are disposed in three spots that are a thenar, a hypothenar and a heel portion, and Figure (b) shows an explanatory view in which a hard shock absorbing structure is provided at an inner side (MEDIAL) of a foot, and a soft shock absorbing structure with a large shock absorbing characteristic is provided at an outer side (LATERAL), and an explanatory view showing a trajectory of a proper pressure center point in this case.
Figure 19:
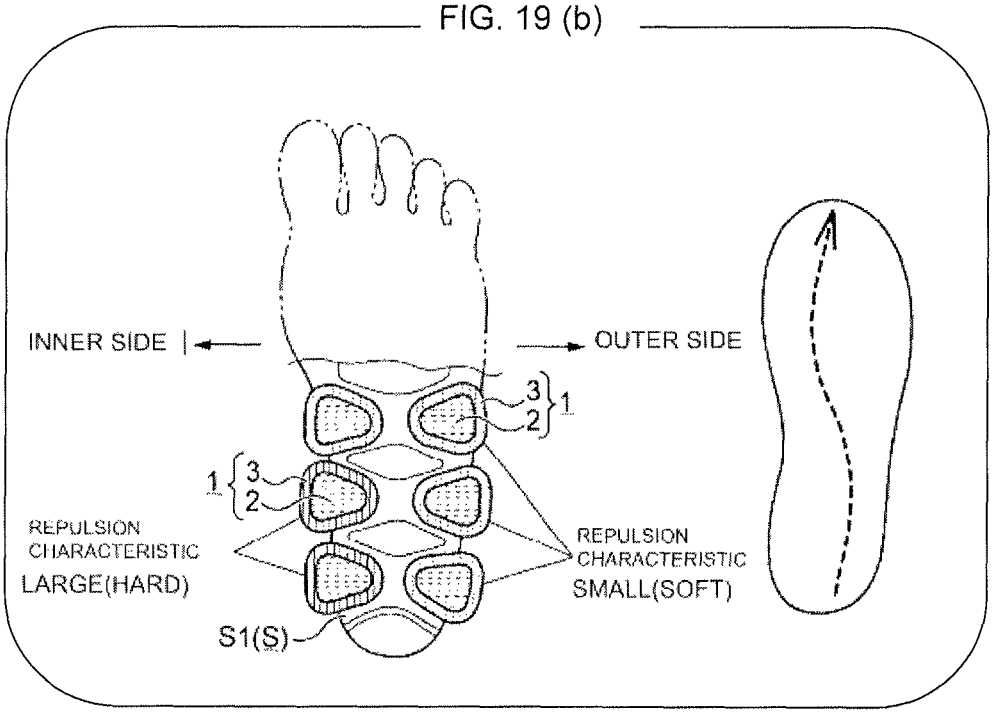

The reason why a larger number of shock absorbing structures 1 are provided on the heel portion than on the thenar and the hypothenar in FIG. 19 (*a*) is that many people land on the ground with heels first at the time of landing on the ground, and large impact is applied to the heels. In this installation example, from the viewpoint of movement of landing from a heel portion to kicking out with a tiptoe, as the shock absorbing structures 1 disposed in the respective portions, the shock absorbing structure 1 with a large shock absorbing characteristic is preferably disposed in the heel portion, and the shock absorbing structures 1 which bring out the effect of the repulsion characteristic to make kicking-out easy are preferably disposed in the thenar and hypothenar portions.

Further, in order to realize smooth guidance of a pressure center point, in the process from landing with the heel portion to kicking out with the tiptoe, the shock absorbing structure 1 is preferably disposed so that the tilting direction of the column member 2 corresponds to the direction of movement of the pressure center point. In order to tilt the column member 2 in a specific direction, the method for setting the inclination angle at an acute angle in the initial state of the column member 2 as described above, the method of adopting the structure in which the tilt guide portion 2*g* is provided at the column member 2, and the like can be applied.

Further, an installation example shown in FIG. 19 (*b*) is an example in which although the shock absorbing structures 1 are incorporated entirely on the sole, the shock absorbing structures 1 with different shock absorbing characteristics are arranged in accordance with installation sites, and in this case, is a mode in which the relatively hard shock absorbing structures 1 (the shock absorbing performance is relatively low, and a repulsion characteristic appears relatively early) are disposed at an inner side (MEDIAL) of the foot, whereas the relatively soft shock absorbing structures 1 (the shock absorbing performance is relatively high, and a repulsion characteristic appears relatively later) are disposed at an outer side (LATERAL) of the foot (the same applies to FIG. 1 (*a*)). In this case, load (the center of gravity) which is applied onto the sole until kicking-out (separation from the ground) after landing on the ground can be moved in a desired direction (load guiding action). The right side in FIG. 19 (*b*) shows a trajectory of the pressure center point in an ordinary running movement.

Figure 21:
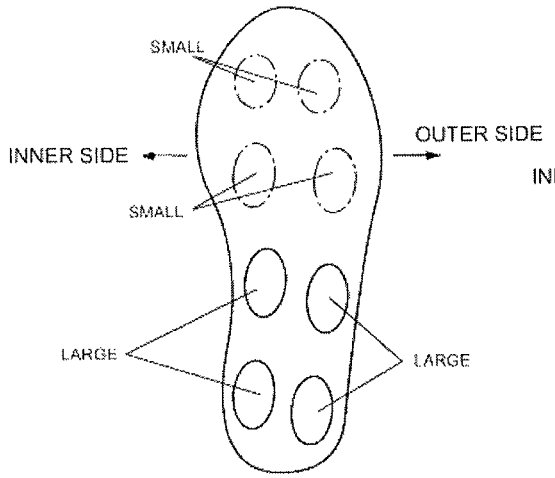
FIG. 21 shows explanatory views showing disposition examples of a repulsion characteristic (hardness) of the shock absorbing structure in a case where a plurality of shock absorbing structures different in performance are disposed in accordance with difference in landing method of a runner.
Figure 21:
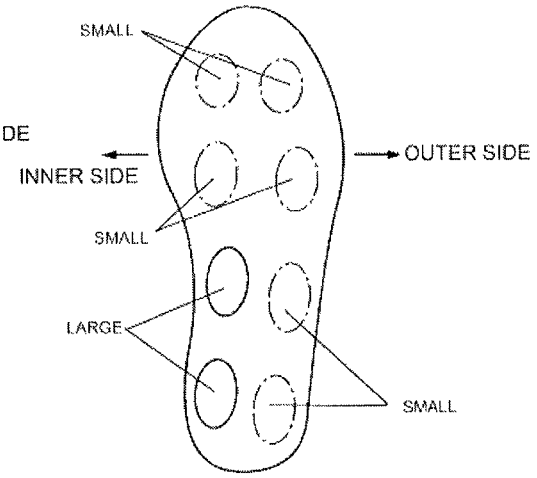

Further, a plurality of shock absorbing structures 1 with different performances may be disposed in accordance with a difference in landing method of a runner. For example, when the shock absorbing structures 1 are applied to shoes suitable for fore foot strike (Fore Foot Strike: landing on a forefoot) which has attracted attention in recent years, a larger number of shock absorbing structures 1 with a large repulsion characteristic are disposed on an entire rear foot portion as shown in FIG. 21 (*a*). Meanwhile, when the shock absorbing structures 1 are applied to the shoes suitable for ordinary rear foot strike (Rear Foot Strike: landing on a rear foot) which lands from a heel outer side, a larger number of shock absorbing structure 1 with a small repulsion characteristic are disposed at an outer side of a rear foot portion as shown in FIG. 21 (*b*). By disposing the shock absorbing structures 1 so as to realize a repulsion balance as shown in FIG. 21, the load (the center of gravity) exerted on the sole can be guided to a proper trajectory of the pressure center point in each of rear foot strike, and forefoot strike.

REFERENCE SIGNS LIST

S Shoe
S1 Sole
S2 Upper
1 Shock absorbing structure
2 Column member
3 Ring member
4 Pressure receiving portion
5 Action wait portion
10U Upper part
10D Lower part
2 Column member
2U Upper column member
2D Lower column member
2*g* tilt guide portion
20 Cutout
21 column body
21U Upper column body
21D Lower column body
22 Flange body
22U Upper flange body
22D Lower flange body
3 Ring member
3U Upper side ring member
3D Lower side ring member
3*h* Column reception hole
31 Cutout
32 Small hole
33 Groove
4 Pressure receiving portion
4U First pressure receiving portion
4D Second pressure receiving portion
41 Return
4*w* Wide angle opening side
4*n* Narrow angle opening side
4*r* Bulging restriction portion
5 Action wait portion
C Clearance
NS Unfilled space
51 Protrusion
AS Ring deformation allowing space
ER Bulging restriction portion

The invention claimed is:

1. A shock absorbing structure, comprising:

a column member;

a ring member that is provided by being fitted onto the column member and has elasticity;

a first pressure receiving portion that is connected to an upper end of the column member; and a second pressure receiving portion that is connected to a lower end of the column member, wherein the column member tilts with respect to at least one of the first and second pressure receiving portions with pressure reception, and is restored with decompression, the tilting of the column member being in a manner so as to decrease an angle which is formed by the second pressure receiving portion and the column member which is formed obliquely to the second pressure receiving portion, wherein the ring member is caused to undergo bulging deformation to an outer circumferential side direction from an inner circumferential side by the tilting of the column member, the bulging deformation occurring by virtue of the ring member being compressed by the first and second pressure receiving portions when the column member tilts, and wherein the first pressure receiving portion is slidable along an axis perpendicular to a thickness direction of the first pressure receiving portion, and the second pressure receiving portion is slidable along an axis perpendicular to a thickness direction of the second pressure receiving portion.

2. The shock absorbing structure according to claim 1, wherein an action wait portion is provided in at least one space of a space between the ring member and the first pressure receiving portion, and a space between the ring member and the second pressure receiving portion.

3. The shock absorbing structure according to claim 1, wherein compression deformation and shearing deformation by the first and second pressure receiving portions are further added to the ring member, in a process of advance of bulging deformation from the inner circumferential side to the outer circumferential side direction following tilting of the column member.

4. The shock absorbing structure according to claim 1, wherein the column member has a part that is formed in an inclined state with respect to at least one of the first and second pressure receiving portions in an initial state where no load is applied.

5. The shock absorbing structure according to claim 1, wherein the column member has a tilt guide portion that promotes tilting at a time of pressure reception.

6. The shock absorbing structure according to claim 1, wherein the first and second pressure receiving portions are set to be in an unparallel state in an initial state where no load is applied.

7. The shock absorbing structure according to claim 1, wherein the column member further has a flange body that extends to an outer circumferential direction, and at least a part of the flange body is embedded inside the ring member.

8. The shock absorbing structure according to claim 1, wherein the second pressure receiving portion is a shoe sole.

9. The shock absorbing structure according to claim 1, wherein in at least either one of contact faces of the ring member and the column member, a ring deformation allowing space in a depressed concave shape is formed.

10. The shock absorbing structure according to claim 1, further comprising:

a bulging restriction portion that restricts bulging deformation of the ring member, wherein the bulging restriction portion is disposed outside the ring member.

11. The shock absorbing structure according to claim 1, wherein at least one of the ring member and the column member is configured by parts having a plurality of different materials or different properties.

12. The shock absorbing structure according to claim 1, wherein the column member is configured by a plurality of members to be connectable in an axial direction.

13. The shock absorbing structure according to claim 1, wherein the ring member is attached to the column member detachably and attachably.

14. The shock absorbing structure according to claim 1, wherein in the column member, at least any one of a convex portion, a concave portion and a constricted portion for grasping the ring member in a middle stage of the column member is formed on a surface, and is provided by being fitted to the ring member.

15. A shoe formed by incorporating a shock absorbing structure that absorbs impact that is applied to a leg of a wearer at a time of landing on a ground, into a sole, wherein the shock absorbing structure according to claim 1 is applied to the shock absorbing structure.

16. The shoe according to claim 15, wherein the shock absorbing structure is disposed with a tilting direction of the column member set at a direction to guide a trajectory of a pressure center point at a time of running or walking.

* * * * *